US009235997B2

(12) United States Patent
Kawanami

(10) Patent No.: US 9,235,997 B2
(45) Date of Patent: Jan. 12, 2016

(54) IMAGE DISPLAY PANEL, IMAGE DISPLAY PANEL INSTALLATION EQUIPMENT, AND MANUFACTURING METHOD FOR IMAGE DISPLAY PANEL

(75) Inventor: Kozo Kawanami, Kyoto (JP)

(73) Assignee: Kawanami Ironworks Inc., Kyoto (JP)

( * ) Notice: Subject to any disclaimer, the term of this patent is extended or adjusted under 35 U.S.C. 154(b) by 0 days.

(21) Appl. No.: 13/811,565

(22) PCT Filed: Nov. 5, 2011

(86) PCT No.: PCT/JP2011/075513

§ 371 (c)(1),
(2), (4) Date: Jan. 22, 2013

(87) PCT Pub. No.: WO2012/060455

PCT Pub. Date: May 10, 2012

(65) Prior Publication Data

US 2013/0118048 A1 May 16, 2013

(30) Foreign Application Priority Data

Nov. 5, 2010 (JP) ..... 2010-249002

(51) Int. Cl.
*G09F 13/16* (2006.01)
*B44F 1/02* (2006.01)
(Continued)

(52) U.S. Cl.
CPC ..... *G09F 13/16* (2013.01); *B44C 1/222* (2013.01); *B44F 1/02* (2013.01); *B44F 7/00* (2013.01); *Y10T 409/303752* (2015.01)

(58) Field of Classification Search
CPC ..... G09F 13/16
USPC ..... 40/582
See application file for complete search history.

(56) References Cited

U.S. PATENT DOCUMENTS

| | | | |
|---|---|---|---|
| 5,951,925 | A | 9/1999 | Mucciacciaro |
| 2002/0095236 | A1 | 7/2002 | Dundorf |
| 2011/0026208 | A1 | 2/2011 | Utsuro et al. |

FOREIGN PATENT DOCUMENTS

| | | | |
|---|---|---|---|
| BE | 1 017 990 | A3 | 3/2010 |
| EP | 0 863 024 | A2 | 9/1998 |

(Continued)

OTHER PUBLICATIONS

International Search Report, mailed Jan. 24, 2012.

(Continued)

*Primary Examiner* — Casandra Davis
(74) *Attorney, Agent, or Firm* — Michael Best & Friedrich LLP

(57) ABSTRACT

Provided is an image display panel, image display panel installation equipment, and a manufacturing method for an image display panel, which display an image by using reflective light and realize a high reproducibility of a base image with a simple method. An image is displayed by a plate-like body processed through carving work. The plate-like body has a main portion made of a metal reflecting light and a surface layer portion made of a material absorbing light more than the main portion. The carving work forms linear V-shaped grooves on the front surface side of the plate-like body such that each minute section includes a plurality of grooves. Shading of the image is expressed by the depths of the V-shaped grooves. The image is displayed by light absorption on the surface layer portion and light reflection on the V-shaped grooves.

24 Claims, 21 Drawing Sheets

(51) Int. Cl.

| | |
|---|---|
| ***B44F 7/00*** | (2006.01) |
| ***B44C 1/22*** | (2006.01) |

(56) References Cited

FOREIGN PATENT DOCUMENTS

| | | | |
|---|---|---|---|
| JP | 06-063810 | A | 3/1994 |
| JP | 09-290314 | A | 11/1997 |
| JP | 2001-270300 | A | 10/2001 |
| JP | 2004-050713 | A | 2/2004 |
| JP | 3125166 | U | 9/2006 |
| JP | 2009-154462 | A | 7/2009 |
| JP | 2009-286076 | A | 12/2009 |
| WO | WO-2010/070788 | A1 | 6/2010 |

OTHER PUBLICATIONS

International Preliminary Report on Patentability.

Written Opinion of the International Searching Authority, mailed Jan. 24, 2012.

Supplementary European Search Report issued in European Application No. 11838105.2, dated Sep. 8, 2015.

FIG.4
FIG.4(a)
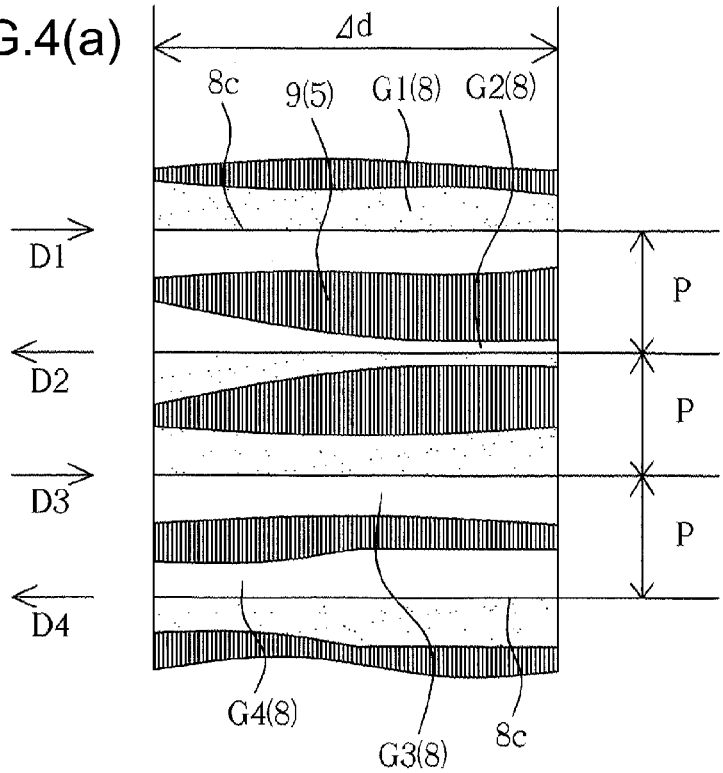
FIG.4(b)
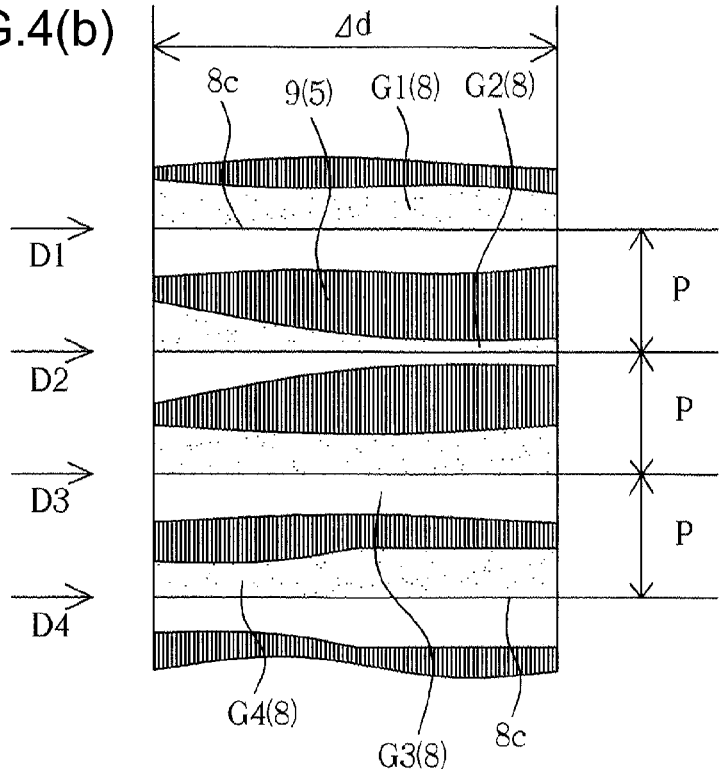

FIG.5
FIG.5(a)
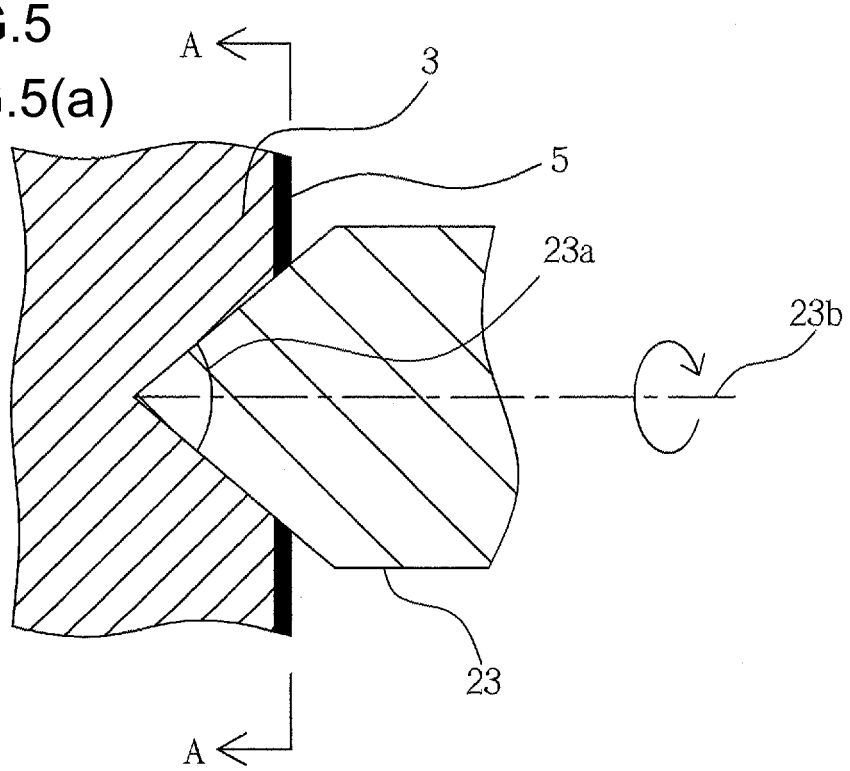
FIG.5(b)
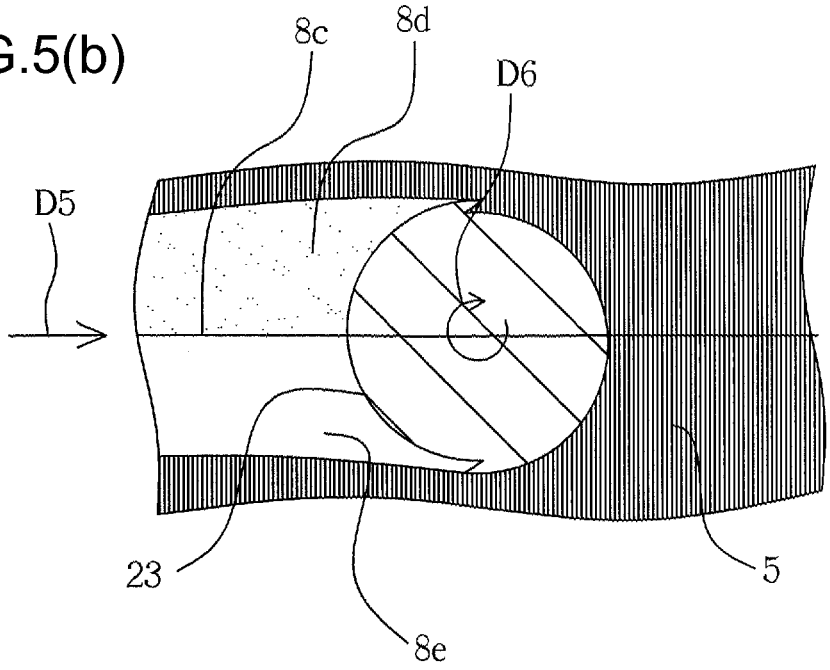

FIG.6
FIG.6(a)
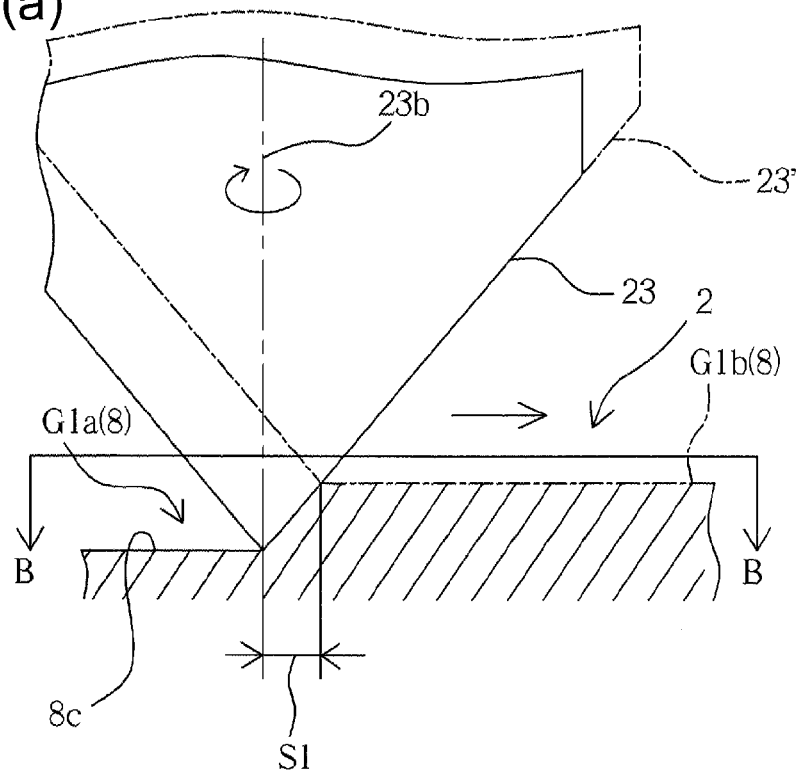
FIG.6(b)
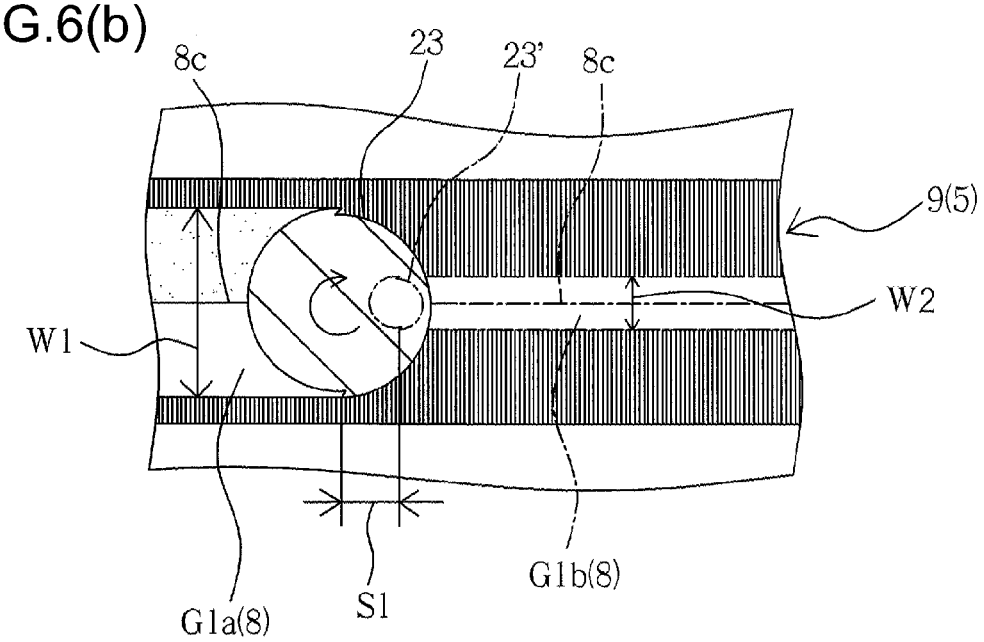

FIG.7
FIG.7(a)
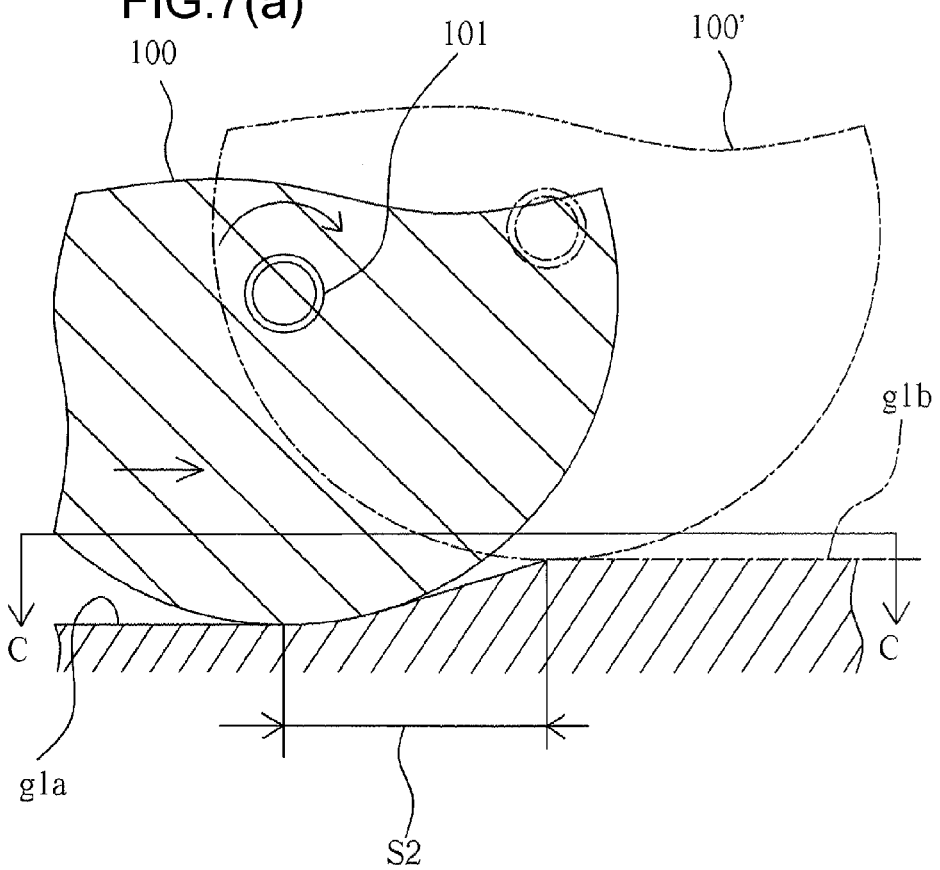
FIG.7(b)
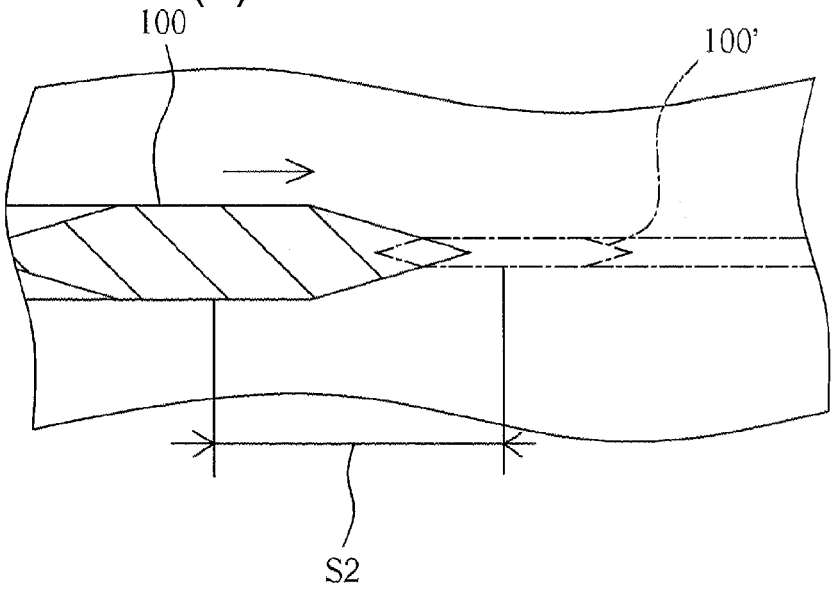

FIG.8
FIG.8(a)
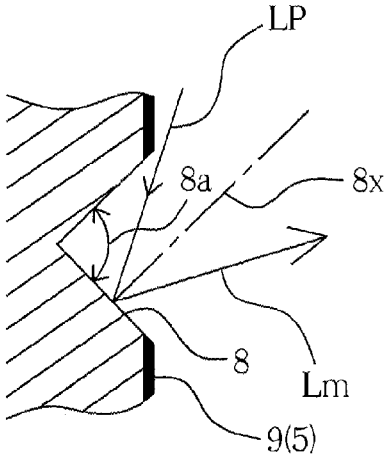
FIG.8(b)
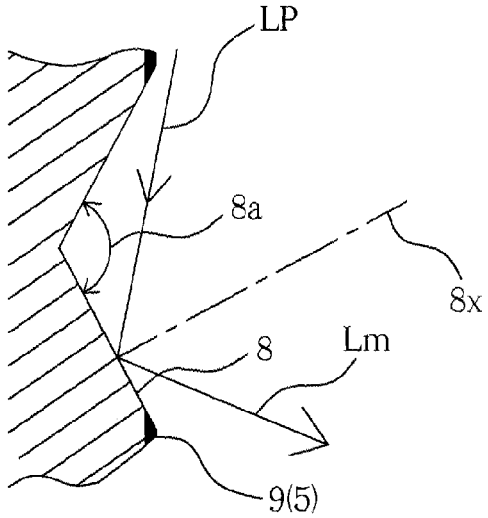
FIG.8(c)
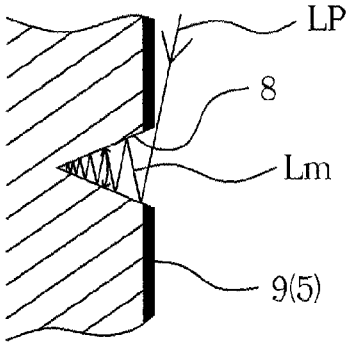

FIG.13
FIG.13(a)
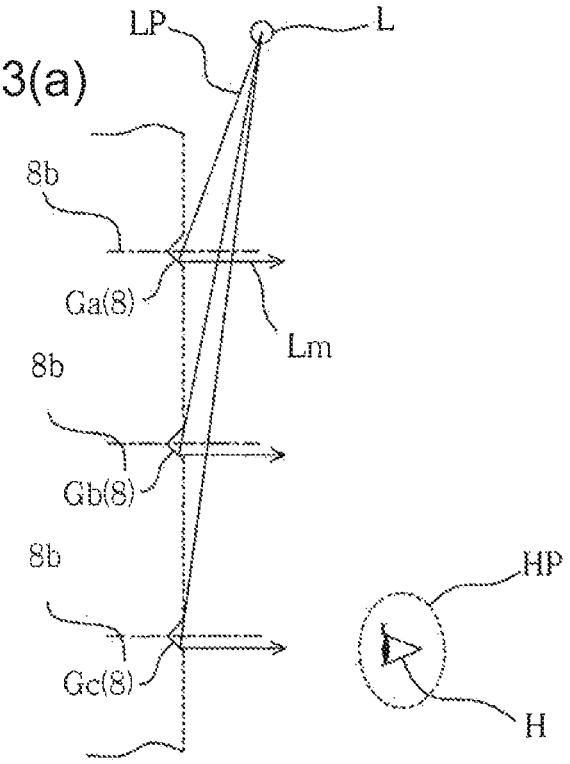
FIG.13(b)
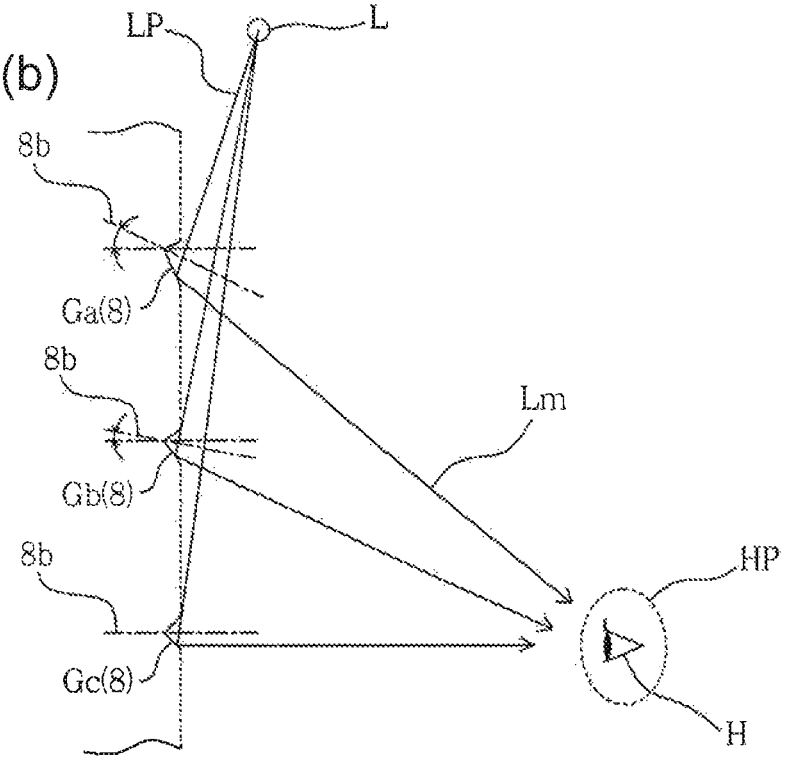

FIG.14
FIG.14(a)
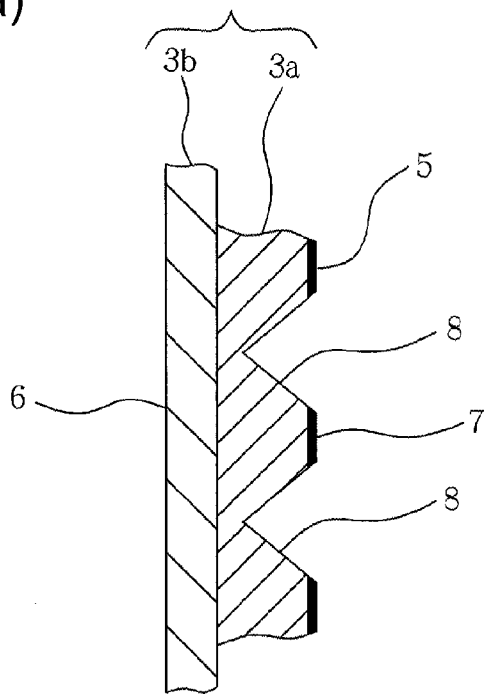
FIG.14(b)
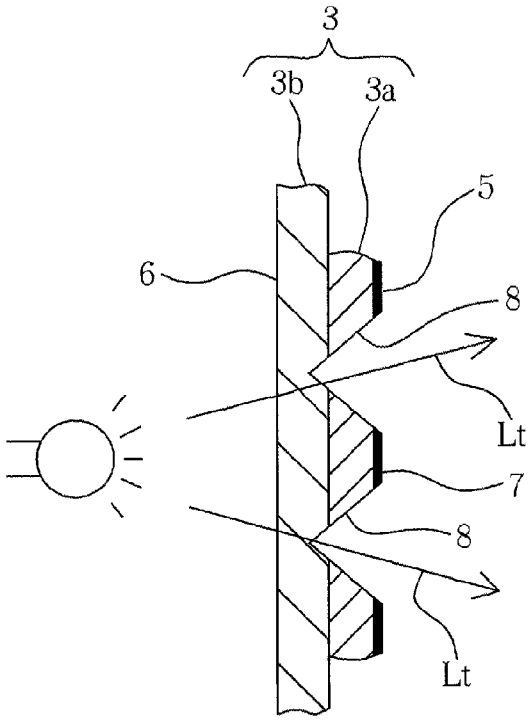

FIG.16
FIG.16(a)
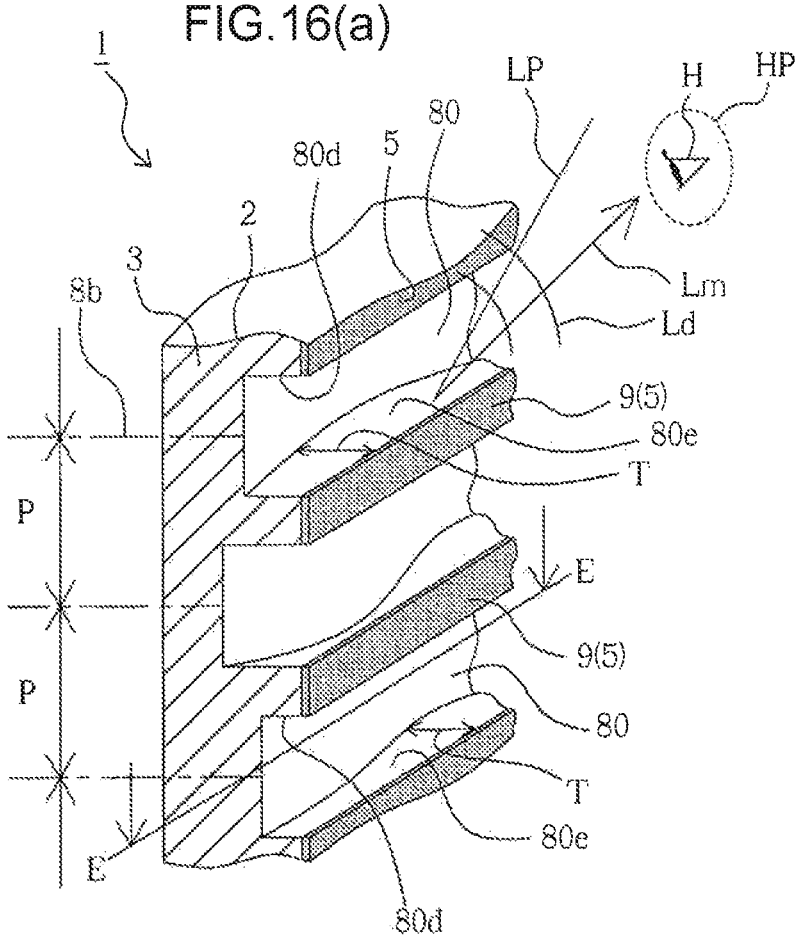
FIG.16(b)
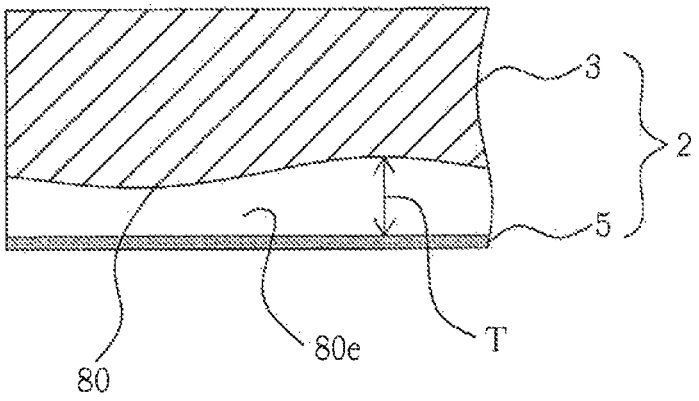

FIG.19
FIG.19(a)
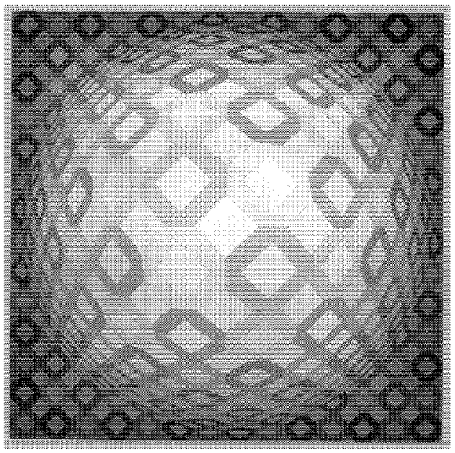
FIG.19(b)
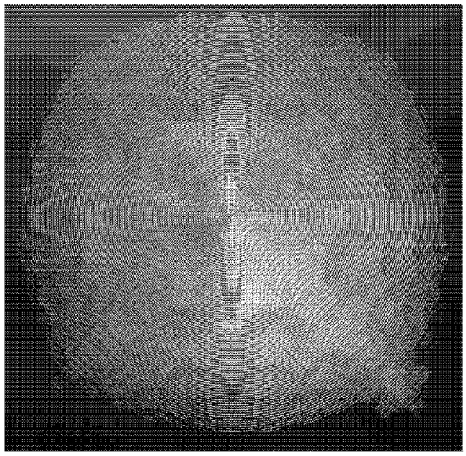
FIG.19(c)
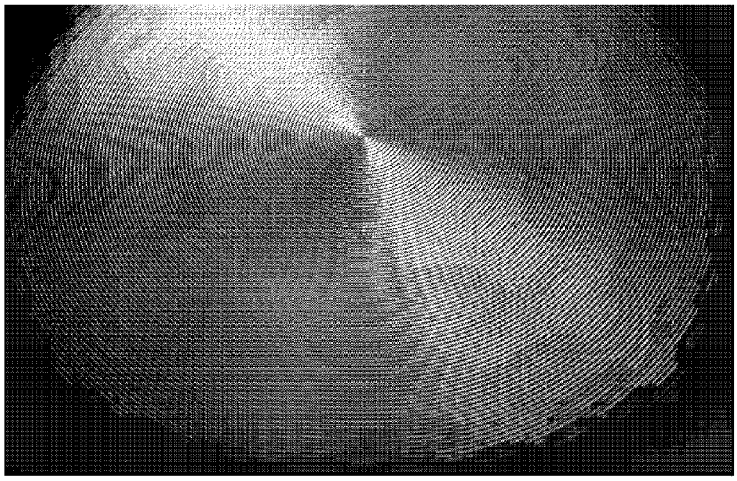

FIG.20
FIG.20(a)
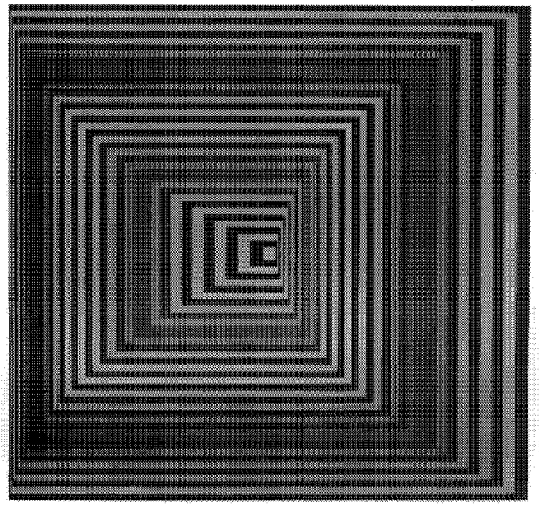
FIG.20(b)
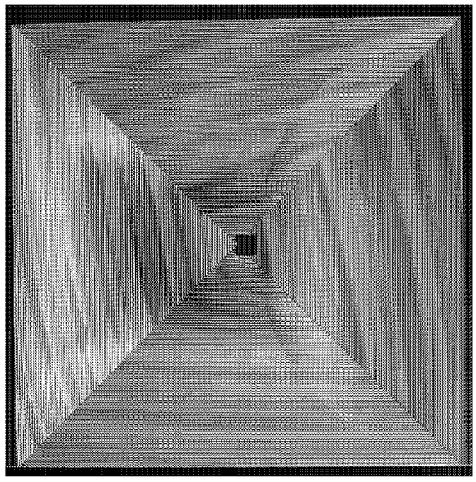
FIG.20(c)
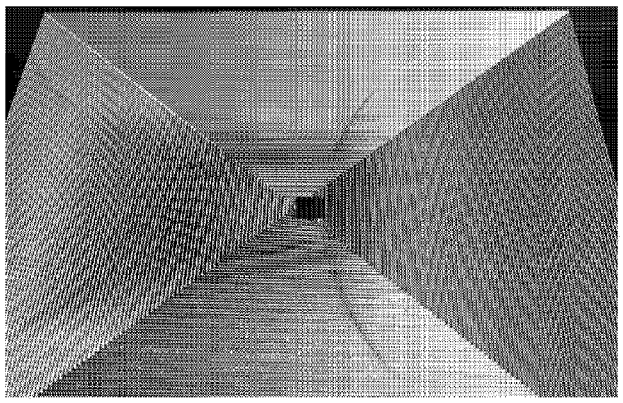

IMAGE DISPLAY PANEL, IMAGE DISPLAY PANEL INSTALLATION EQUIPMENT, AND MANUFACTURING METHOD FOR IMAGE DISPLAY PANEL

TECHNICAL FIELD

The present invention relates to an image display panel, image display panel installation equipment, and a manufacturing method for an image display panel. In more detail, the present invention relates to an image display panel, image display panel installation equipment, and a manufacturing method for an image display panel, which display an image by a plate-like body being processed through carving work.

BACKGROUND ART

Conventionally, examples of such image display panels as described above are disclosed in Patent Documents 1 and 2. Patent Document 1 discloses a metal plate having multiple grooves extending longitudinally and laterally on the surface of the metal plate and also having multiple diagonal grooves thereon, so as to be stereoscopically visible. Therefore, it is necessary to form grooves in a plurality of directions, thus making the manufacture difficult.

In addition, Patent Document 2 discloses an interior object made from a light-transmissive material plate having concave and convex portions corresponding to shading of a base image such as a picture, so as to provide stereoscopic effect. Therefore, it is necessary to perform precise and complicated stereoscopic work in accordance with variation in contrast, and light transmitted from the back surface is needed.

CITATION LIST

Patent Documents

[PATENT DOCUMENT 1] Japanese Laid-Open Patent Publication No. 2001-270300

[PATENT DOCUMENT 2] Japanese Laid-Open Patent Publication No. 2004-50713

SUMMARY OF THE INVENTION

Problems to be Solved by the Invention

In view of the above conventional circumstance, an object of the present invention is to provide an image display panel, image display panel installation equipment, and a manufacturing method for an image display panel, which display an image by using reflective light based on different structure and principle from conventional ones, and realize a high reproducibility of a base image with a simple method.

Solution to the Problems

In order to achieve the above object, an image display panel according to the present invention has the following feature. That is, the image display panel displays an image by a plate-like body being processed through carving work, wherein the plate-like body has a main portion made of a metal that reflects light radiated from the front surface side of the plate-like body, and a surface layer portion which is provided on the front surface side and made of a material that absorbs the light more than the main portion, the carving work forms V-shaped grooves that are linear, on the front surface side of the plate-like body, such that a plurality of the V-shaped grooves are arranged at a predetermined pitch in each of minute sections on the front surface and the main portion is exposed on the front surface side by the V-shaped grooves, each V-shaped groove is formed while the depth thereof is adjusted along the line direction of the V-shaped groove to change the line width of the V-shaped groove and the width of the surface layer portion along the line direction, thereby expressing shading of the image, and the image is displayed by absorption of the light on the surface layer portion and reflection of the light from the main portion exposed by the V-shaped grooves. As macroscopically viewed, the V-shaped grooves may be formed in a circular fashion as shown in FIGS. 18(*a*), (*d*), and (*e*), in a spiral fashion as shown in FIG. 18(*c*), or in a linear fashion such that the V-shaped grooves cross the entire image as shown in FIG. 12. Each minute section is as shown by a sign Δd in FIGS. 4 and 18(*a*) and (*b*), and thus the grooves are aligned like substantially straight lines as microscopically viewed, though they are curved lines as macroscopically viewed. In the case of linear fashion, the carving work may be referred to as work of forming a plurality of V-shaped grooves that are linear, so as to extend in the lateral direction of the image to be displayed by the carving work.

According to the above configuration, mirror surface reflective light and scattered reflective light caused by the V-shaped grooves are mixed, thereby increasing stereoscopic effect. In addition, since the carving work forms V-shaped grooves that are linear, on the front surface side of the plate-like body, such that a plurality of the V-shaped grooves are arranged in each of minute sections on the front surface, the V-shaped grooves can be formed continuously between adjacent minute sections, thus simplifying the carving work.

In this case, the V-shaped grooves may be formed by rotational cutting with a cutting tool having a conical tip. By using a rotational cutting tool such as an end mill that allows fine adjustment of cutting depth, fine adjustment of the line width of the V-shaped grooves can be easily conducted, thereby increasing reproducibility of elaborate images. Further, since a state of rough surface is added by up-cut or down-cut, richness can be added to an image.

In addition, the V-shaped grooves may be formed such that center lines of the V-shaped grooves in a cross section with respect to the line width direction of the V-shaped grooves in each minute section are oriented in directions different from each other, or the V-shaped grooves may be formed such that the center lines of the V-shaped grooves in each minute section are inclined toward a reference observation position of a panel observer who observes the image display panel.

In addition, the carving work of the V-shaped grooves in each minute section may be conducted so as to progress in the same direction, or the carving work of the V-shaped grooves in each minute section may be conducted so as to progress in different directions between the adjacent lines of the V-shaped grooves.

Further, the angle of each V-shaped groove may be 50 to 145 degrees. If the angle of each V-shaped groove is smaller than 50 degrees, sufficient reflective light for causing the effect of the present invention cannot be obtained. On the other hand, if the angle of each V-shaped groove is larger than 145 degrees, the directions of reflective light diffuse, and sufficient reflective light for causing the effect of the present invention cannot reach an observer. The angle of each V-shaped groove may be 90 degrees. Since the blade tip angles of generally available cutting tools are usually 90 degrees, the production cost can be suppressed.

Some of portions, of the surface layer portion, between the V-shaped grooves may be entirely removed. Since some portions of the surface layer portion which absorbs light are not present, diffraction occurs to a greater extent, thereby expressing shading with a sense of transparency.

In addition, the main portion of the plate-like body may be composed of a metal thin plate and a synthetic resin thin plate bonded together. This allows reduction in weight as compared to the case where the entirety of the main portion is made of a metal. In addition, if the carving work reaches the synthetic resin thin plate, two-color combination or transmitted light can be used, thereby realizing different expression.

In addition, in order to achieve the above object, image display panel installation equipment according to the present invention has the following feature. That is, the image display panel installation equipment includes the above image display panel and a lighting apparatus, wherein the lighting apparatus is placed in an oblique direction inclined in the line width direction from the center lines in the cross section with respect to the line width direction of the V-shaped grooves in each minute section.

Further, in order to achieve the above object, a manufacturing method for an image display panel according to the present invention has the following feature. That is, the manufacturing method for the image display panel displays an image by a plate-like body being processed through carving work, wherein the plate-like body has a main portion made of a metal that reflects light radiated from the front surface side of the plate-like body, and a surface layer portion which is provided on the front surface side and made of a material that absorbs the light more than the main portion, the carving work forms V-shaped grooves that are linear, on the front surface side of the plate-like body, such that a plurality of the V-shaped grooves are arranged at a predetermined pitch in each of minute sections on the front surface and the main portion is exposed on the front surface side by the V-shaped grooves, the V-shaped grooves are formed by rotational cutting with a cutting tool having a conical tip, each V-shaped groove is formed while the depth thereof is adjusted along the line direction of the V-shaped groove to change the line width of the V-shaped groove and the width of the surface layer portion along the line direction, thereby expressing shading of the image, and the image is displayed by absorption of the light on the surface layer portion and reflection of the light from the main portion exposed by the V-shaped grooves.

In this case, the image may be one of a plurality of images obtained by dividing the entire image which is displayed by combination of a plurality of the image display panels, a sample image collection may be generated by collecting sample image parts sampled from a plurality of portions of the entire image, the sample image parts include a cutting work starting part having a reference brightness for starting the carving work, for each image display panel, a reference image display panel may be created through the carving work using the sample image collection, and the brightness of the cutting work starting part corresponding to the image, of the reference image display panel, may be compared with the brightness of a portion of the plate-like body where the carving work is started, thereby performing depth adjustment of the carving work. In addition, the surface layer portion may be composed of two or more layers different from each other in hue, colorfulness, or brightness.

Work data for the carving work may be generated such that the pitch of the V-shaped grooves is constant and that the surface layer portion between the V-shaped grooves is left even at a portion with the highest brightness of an original image. If the work is conducted to a deeper extent, the contrast can be adjusted again.

In addition, the carving work of the V-shaped grooves in each minute section may be conducted so as to progress in the same direction, or the carving work of the V-shaped grooves in each minute section may be conducted so as to progress in different directions between the adjacent lines of the V-shaped grooves.

A transparent protection layer may be further provided on the surface layer side. Thus, the V-shaped grooves are protected, so that the image display panel can be used as a table or the like. Further, as macroscopically viewed, the V-shaped grooves may be formed so as to extend in a circular or spiral fashion, and the image display panel may be used substantially in a horizontal state. If a light source is placed at an upper position, an image can be effectively displayed to the surrounding area. In addition, the surface layer portion may be composed of two or more layers different from each other in hue, colorfulness, or brightness.

In addition, in order to achieve the above object, an image display panel according to the present invention has another feature described below. That is, the image display panel displays an image by a plate-like body being processed through carving work, wherein the plate-like body has a main portion made of a metal that reflects light radiated from the front surface side of the plate-like body, and a surface layer portion which is provided on the front surface side and made of a material that absorbs the light more than the main portion, the carving work forms concave grooves that are linear, on the front surface side of the plate-like body, such that a plurality of the concave grooves are arranged at a predetermined pitch in each of minute sections on the front surface and the main portion is exposed on the front surface side by the concave grooves, the concave grooves are formed such that both side surfaces thereof are substantially parallel in each minute section, each concave groove is formed while the depth thereof is adjusted along the line direction of the concave groove to change the width of the side surfaces of the concave groove along the line direction, thereby expressing shading of the image, and the image is displayed by absorption of the light on the surface layer portion and reflection of the light from the main portion exposed by the concave grooves.

In addition, in order to achieve the above object, image display panel installation equipment according to the present invention has another feature described below. That is, the image display panel installation equipment includes the above image display panel and a lighting apparatus, wherein the lighting apparatus is placed in an oblique direction inclined in the line width direction from the center lines in the cross section with respect to the line width direction of the concave grooves in each minute section, and a reference observation position of a panel observer who observes the image display panel is positioned in a direction inclined by 45 degrees in the width direction of the concave grooves from both side surfaces thereof.

Further, in order to achieve the above object, a manufacturing method for an image display panel according to the present invention has another feature described below. That is, the manufacturing method for the image display panel displays an image by a plate-like body being processed through carving work, wherein the plate-like body has a main portion made of a metal that reflects light radiated from the front surface side of the plate-like body, and a surface layer portion which is provided on the front surface side and made of a material that absorbs the light more than the main portion, the carving work forms concave grooves that are linear, on the front surface side of the plate-like body, such that a plurality of the concave grooves are arranged at a predetermined pitch in each of minute sections on the front surface and the main portion is exposed on the front surface side by the concave grooves, the concave grooves are formed such that both side surfaces thereof are substantially parallel in each minute section, each concave groove is formed while the depth thereof is adjusted along the line direction of the concave groove to change the width of the side surfaces of the concave groove along the line direction, thereby expressing shading of the image, and the image is displayed by absorption of the light on the surface layer portion and reflection of the light from the main portion exposed by the concave grooves.

In order to achieve the above object, an image display panel according to the present invention has still another feature described below. That is, the image display panel which displays an image by a plate-like body being processed through carving work, wherein the plate-like body has a main portion made of a metal that reflects light radiated from the front surface side of the plate-like body, and a surface layer portion which is provided on the front surface side and made of a material that absorbs the light more than the main portion, the carving work forms a plurality of V-shaped grooves that are linear, on the front surface side of the plate-like body, at a predetermined pitch, such that the main portion is exposed on the front surface side by the V-shaped grooves, and each V-shaped groove is formed while the depth thereof is adjusted along the line direction of the V-shaped groove to change the line width of the V-shaped groove and the width of the surface layer portion along the line direction, thereby expressing shading of the image.

Advantageous Effects of the Invention

Owing to the above features of the image display panel, the image display panel installation equipment, and the manufacturing method for the image display panel according to the present invention, it becomes possible to provide an image display panel, image display panel installation equipment, and a manufacturing method for an image display panel, which display an image by using reflective light based on different structure and principle from conventional ones, and realize an extremely high reproducibility of a base image with a simple method.

Other objects, configurations, and effects of the present invention will become apparent from the following embodiments of the present invention.

BRIEF DESCRIPTION OF THE DRAWINGS

FIG. 4 shows enlarged front views of the image display panel, in which a diagram (a) shows the case where carving work of V-shaped grooves is conducted so as to progress in different directions between the adjacent lines, and a diagram (b) shows the case where carving work of V-shaped grooves is conducted so as to progress in the same direction.

FIG. 5 shows the relationship between a cutting blade for cutting work and a plate-like body, in which a diagram (a) is a longitudinal sectional view and a diagram (b) is a sectional view along A-A line of the diagram (a).

FIG. 6 shows work of the present invention, in which a diagram (a) is a longitudinal sectional view and a diagram (b) is a sectional view along B-B line of the diagram (a).

FIG. 7 shows conventional work, in which a diagram (a) is a longitudinal sectional view and a diagram (b) is a sectional view along C-C line of the diagram (a).

FIG. 8 is sectional views showing situations of mirror surface reflection based on different groove angles of the V-shaped groove, in which a diagram (a) shows the case of appropriate groove angle, a diagram (b) shows the case of extremely wide groove angle, and a diagram (c) shows the case of extremely narrow groove angle.

FIG. 13 shows the second embodiment, in which a diagram (a) shows the case where the V-shaped grooves are formed such that all the center lines of the V-shaped grooves are oriented in the same direction and in parallel, and a diagram (b) shows the case where the V-shaped grooves are formed such that the center lines of the V-shaped grooves are inclined toward a reference observation position of a panel observer.

FIG. 14 shows the third embodiment and is sectional views of a plate-like body with its main portion formed by further bonding a synthetic resin thin plate onto the back surface of a metal thin plate, in which a diagram (a) shows the case where the metal thin plate is thicker than the depth of the V-shaped grooves, and a diagram (b) shows the case where the metal thin plate is thinner than the depth of the V-shaped grooves.

FIG. 16 shows the fifth embodiment, in which a diagram (a) shows a perspective sectional view when concave grooves are formed by carving work, and a diagram (b) shows a sectional view along E-E line of the diagram (a).

FIG. 19 shows an example of the image display panel having the V-shaped grooves formed in a spiral fashion, in which a diagram (a) is a display image original graphic, a diagram (b) is a plan picture, and a diagram (c) is a picture taken from a perspective direction.

FIG. 20 shows an example of the image display panel having the V-shaped grooves formed into a plurality of quadrangular shapes, in which a diagram (a) is a display image original graphic, a diagram (b) is a plan picture, and a diagram (c) is a picture taken from a perspective direction.

DESCRIPTION OF EMBODIMENTS

Next, the first embodiment of the present invention will be described with reference to the drawings as necessary.

Figure 1:
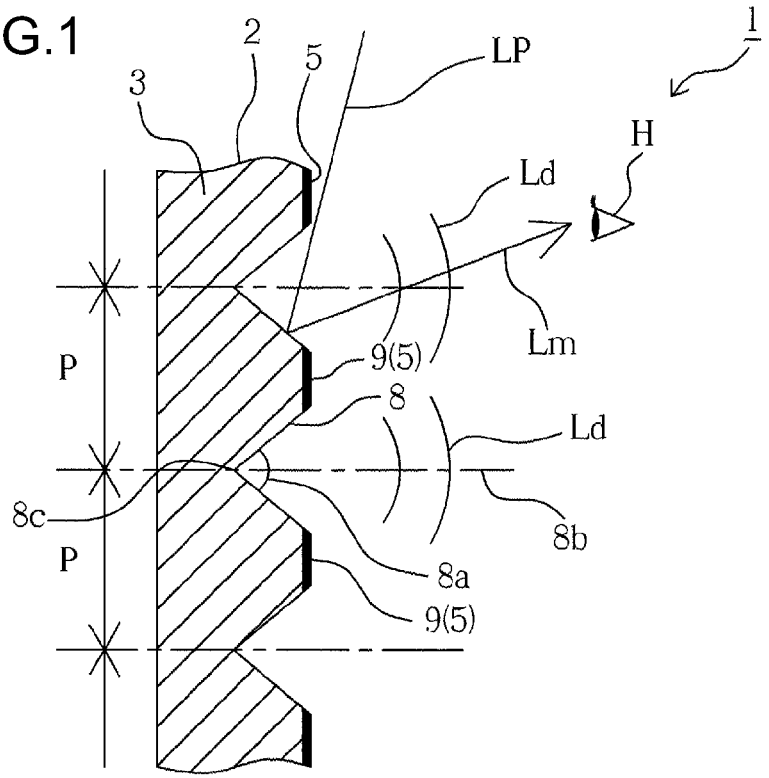
FIG. 1 is an enlarged sectional view illustrating the principle of an image display panel according to the present invention.

As shown in FIGS. 1 and 4, roughly, an image display panel 1 according to the first embodiment is manufactured by forming V-shaped grooves 8 corresponding to shading of the entire image to be displayed, on a plate-like body 2 composed of a main portion 3 made of a metal and a surface layer portion 5.

Figure 9:
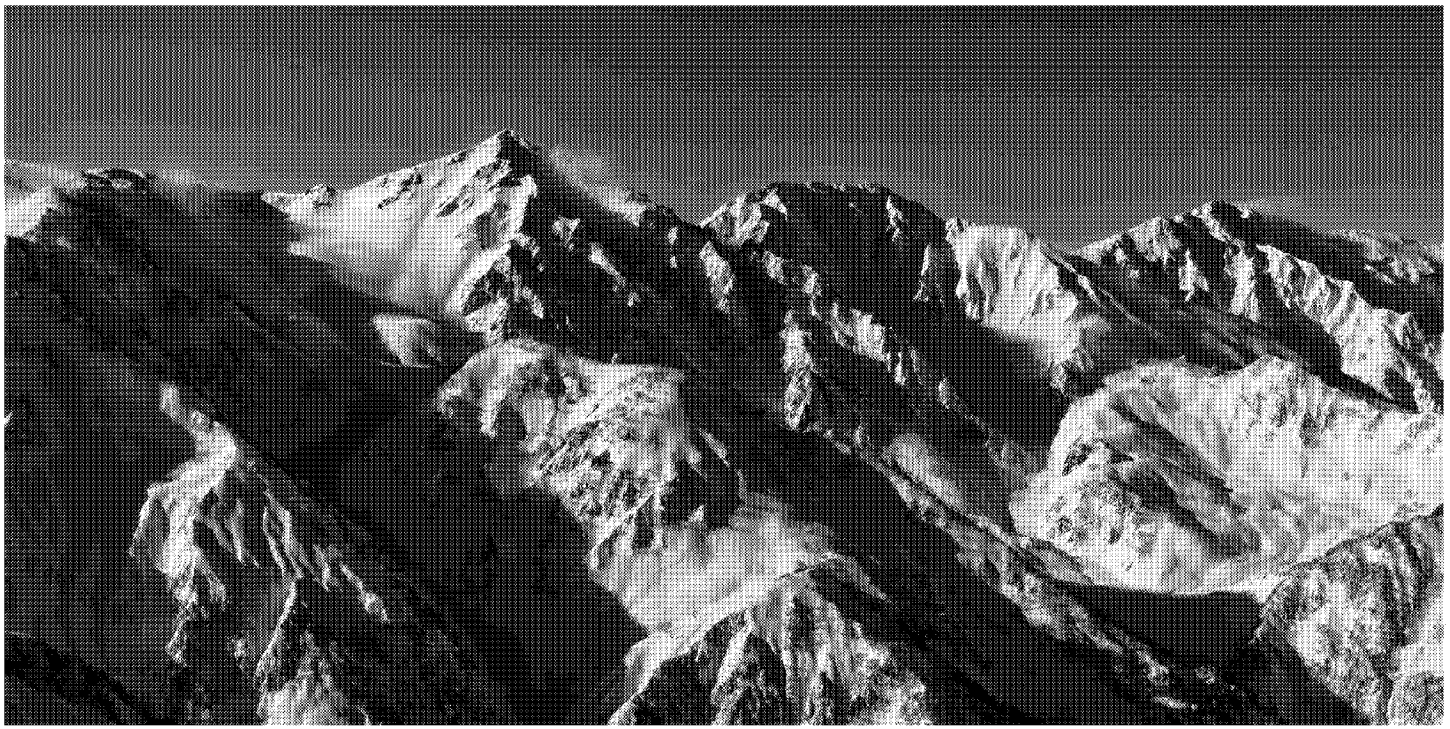
FIG. 9 is a diagram showing the entire image to be displayed.
Figure 10:
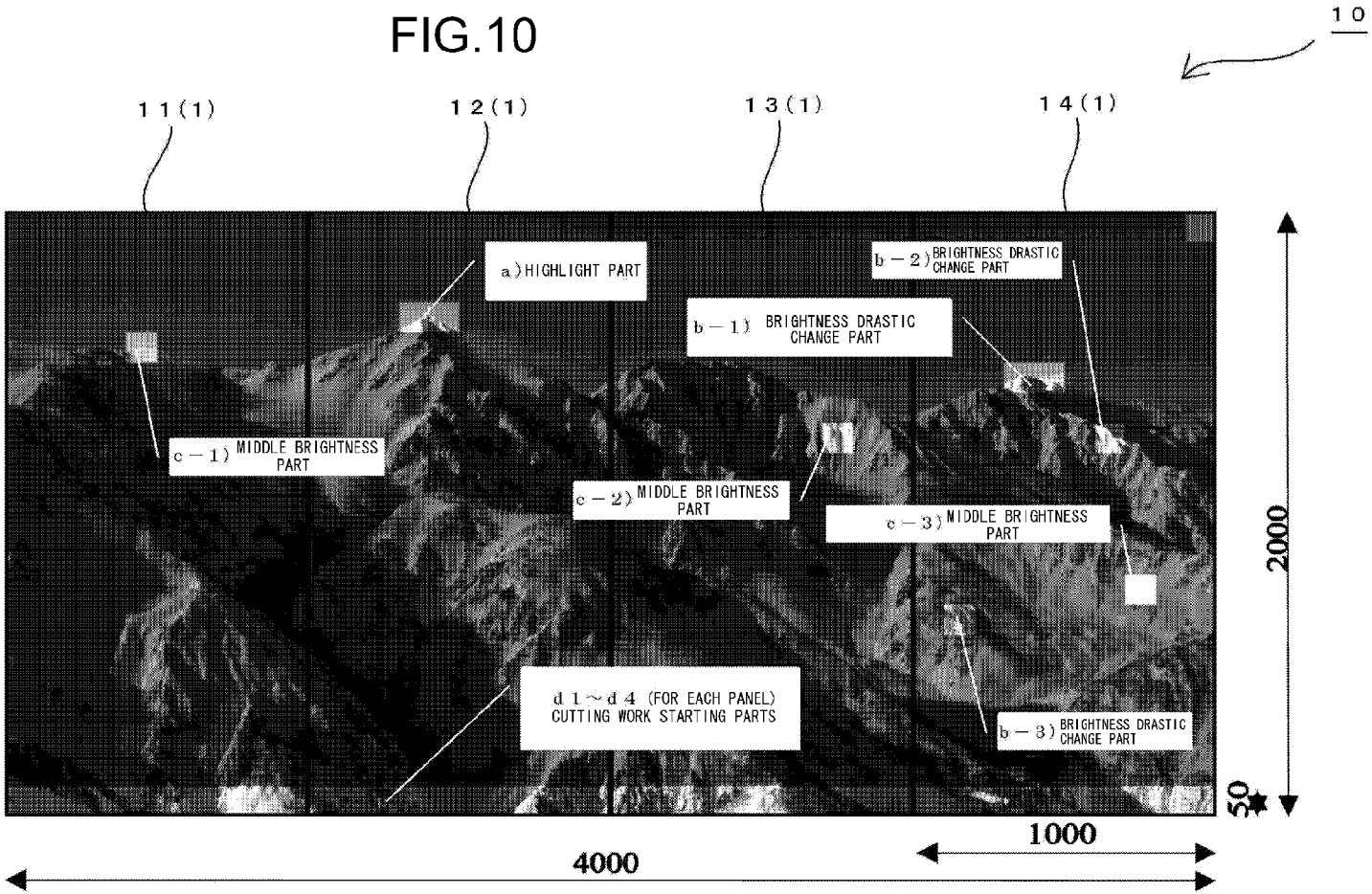
FIG. 10 is a diagram showing allocation of the entire image into a plurality of panels and allocation of sample image parts.
Figure 12:
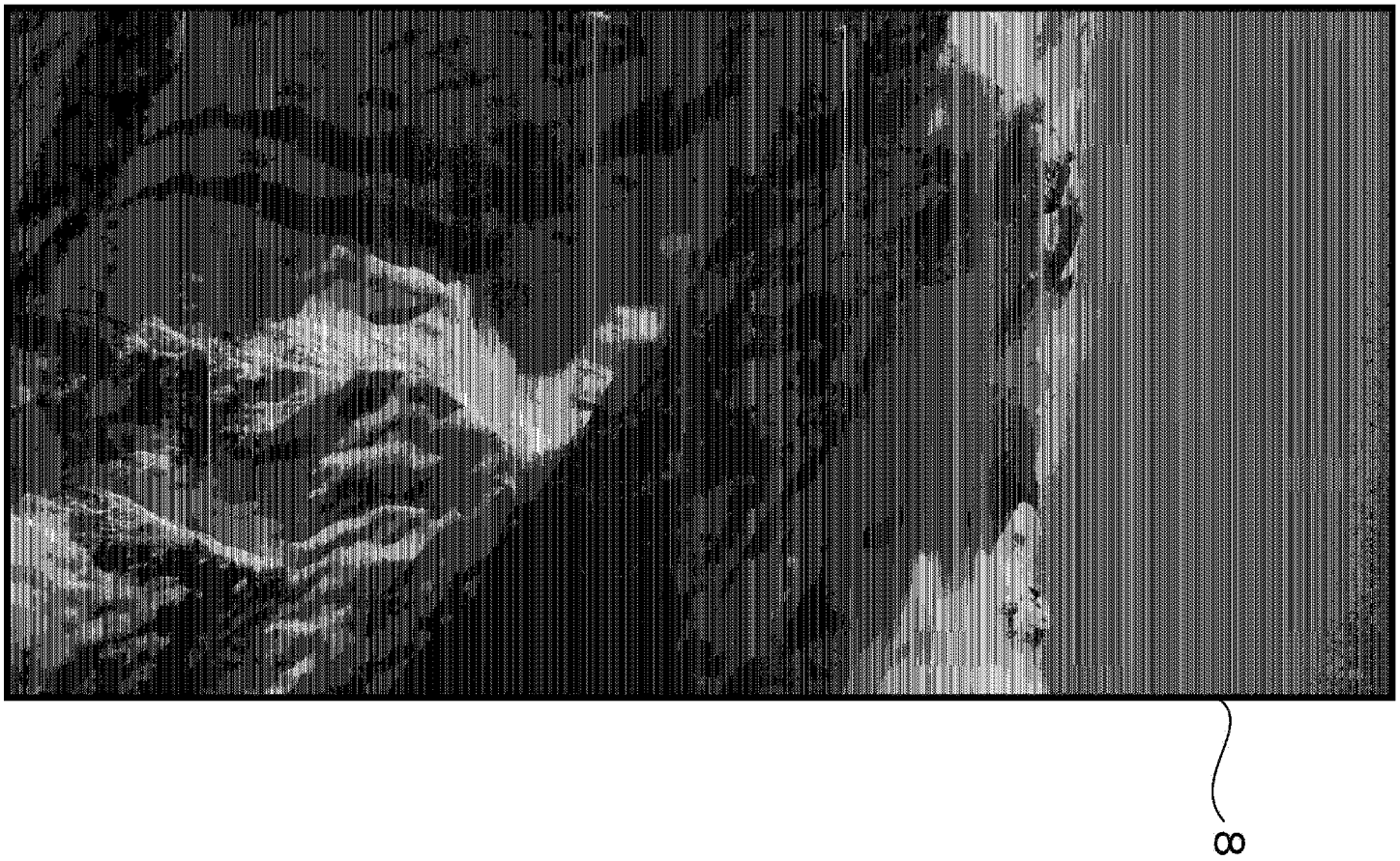
FIG. 12 is a diagram showing the output result of work simulation for a first image part.

The entire image 10 shown in FIGS. 9 and 10 is divided into, for example, four image parts, e.g., a first image part 11 to a fourth image part 14, and each image part becomes the image display panel 1. In the entire image 10, for example, if work simulation is performed for the first image part 11, the output result is displayed as shown in FIG. 12.

The depth of the V-shaped grooves 8 is adjusted so as to correspond to the output result of the work simulation of image data to express shading. At a dark portion of the image, carving work is conducted shallowly so as to maintain the surface layer portion 5(9) or the surface layer portion 5(9) is left as it is without carving work. At a light portion of the image, carving work is conducted deeply so as to widely expose the main portion 3.

Figure 2:
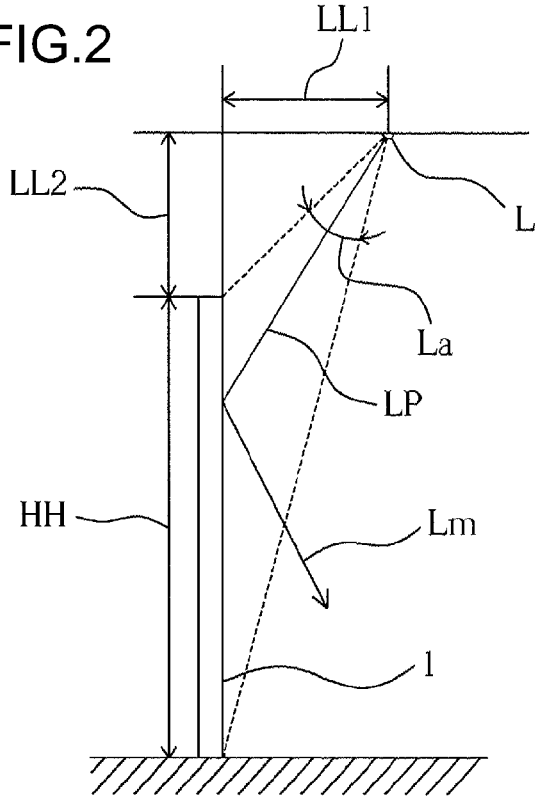
FIG. 2 is a side surface view showing installation equipment of the image display panel shown in FIG. 1.

As shown in FIG. 2, the image display panel 1 having processed by the work is incorporated in installation equipment including a lighting apparatus L, so that the image display panel 1 is lit by the lighting apparatus when used. The lighting apparatus L is placed at an obliquely upper position relative to the image display panel 1, for example.

As shown in FIG. 1, at the V-shaped groove 8, if light from the lighting apparatus L passes through a light path LP, the light is reflected as mirror surface reflective light Lm or scattered reflective light Ld. The mirror surface reflective light Lm occurs exiting at the same angle as the angle of incidence into the V-shaped groove 8 as a reflection surface. The scattered reflective light Ld is considered to occur by incoming light into the V-shaped groove 8 being reflected in a scattered manner at the V-shaped groove 8. In addition, owing to diffraction, the scattered reflective light Ld occurring from each V-shaped groove 8 gives an observer H a different impression, depending on the angle and the position to view. Presence of the above two types of light increasingly make a displayed image stereoscopic.

[Mechanical Work]

The main portion 3 of the plate-like body 2 is composed of a metal plate such as aluminum or copper, and the surface layer portion 5 is formed by a material subjected to black alumite treatment being closely adhered to the metal plate. The metal plate has a height of 2,000 mm, a width of 1,000 mm, and a thickness of 1 mm, for example.

Figure 3:
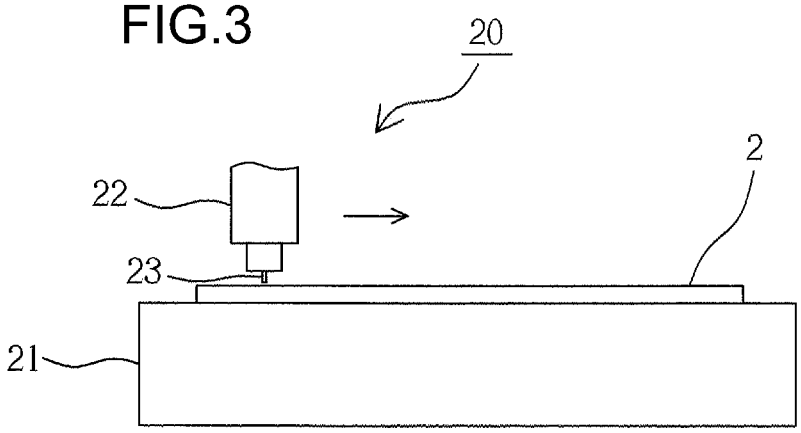
FIG. 3 is a side surface view showing a working apparatus for the image display panel.

As shown in FIG. 3, the V-shaped grooves 8 of the image display panel 1 are formed by mechanical work using a working apparatus 20. The plate-like body 2 is placed on a fixed base 21, and a work 22 moves above the plate-like body 2. A cutting blade 23 for cutting work is attached to the work 22. By the cutting blade 23 moving while rotating, the V-shaped groove 8 is formed on the plate-like body 2, whereby the image display panel 1 is manufactured.

As shown in FIG. 4(*a*), the V-shaped grooves 8 have the same groove pitch P. The cutting blade moves in a direction D1 corresponding to the lateral direction of an image to be displayed, while the depth is adjusted so as to correspond to the output result of work simulation, thereby forming a first V-shaped groove portion G1(8). After finishing the V-shaped groove formation in the direction D1, the cutting blade turns back to move in the opposite direction D2, thereby forming a second V-shaped groove portion G2(8). An inter-groove portion 9 where the surface layer portion 5 is maintained is formed between the adjacent V-shaped grooves 8. Then, the turn-back movement is repeated to form a third V-shaped groove portion G3(8) and a fourth V-shaped groove portion G4(8), thus forming a plurality of V-shaped grooves 8 in the same direction. In this case, a rough surface described later is alternately formed on the upper side surface and the lower side surface in the vertical direction upon installation.

However, as shown in FIG. 4(*b*), the cutting blade may move in the same direction without turning back. That is, after the cutting blade moves in the direction D1 to form the first V-shaped groove portion G1(8), the work 22 only turns back to the original position. Then, the cutting blade moves in the same direction D2 to form the second V-shaped groove portion G2(8). As in the above case, the inter-groove portion 9 where the surface layer portion 5 is maintained is formed between the V-shaped grooves 8, and the movement is repeated to form the third V-shaped groove portion G3(8) and the fourth V-shaped groove portion G4(8), thus forming a plurality of V-shaped grooves 8 in the same direction. In this case, a rough surface described later is always formed on the upper side surface in the vertical direction upon installation.

If the height HH of the image display panel 1 is 2,000 mm, the groove pitch P of the image display panel 1 is set at about 1 to 2 mm, for example. If the groove pitch P is smaller than 1 mm, the image display panel 1 becomes too fine or rather flat, so that stereoscopic effect is lost. On the other hand, if the groove pitch P is larger than 2 mm, the image display panel 1 becomes too rough, so that some of the details are ignored and the expressiveness is deteriorated. Therefore, the groove pitch P is desired to be about 1.5 mm, for example.

If the groove pitch P of the image display panel 1 is 1.5 mm, the maximum depth of the cutting blade 23 is set at 0.5 mm. On this condition, if the cutting blade 23 having a blade tip angle 23*a* of 90 degrees is used, the maximum line width is 0.5 mm×2=1 mm, so that interference between the adjacent V-shaped grooves 8 is prevented and the inter-groove portion 9 remains.

As shown in FIG. 5(*a*), the cutting blade 23 has a conical tip, and the blade tip angle 23*a* is 90 degrees, for example. The cutting blade 23 rotates clockwise around a blade center axis 23*b*, for example. As a matter of course, a cutting blade that rotates counterclockwise may be used.

As shown in FIG. 5(*b*), since the rotation direction D6 of the cutting blade 23 opposes the cut surface in a progressing direction D5, a slope surface 8*d* at which the blade tip of the cutting blade 23 digs into the plate-like body 2 is down-cut to be formed as a rough surface. On the other hand, regarding a slope surface 8*e* opposite to the slope surface 8*d*, since the rotation direction D6 of the cutting blade 23 is the same as the movement direction of the cut surface in a progressing direction D5, the blade tip slides on the plate-like body 2, so that the slope surface 8*e* is up-cut to be smoother than the down-cut rough surface.

Since the up-cut slope surface 8*e* is smoother than the down-cut slope surface 8*d*, the slope surface 8*e* causes more reflective light. Therefore, as shown in FIG. 4(*b*), if the up-cut slope surface 8*e* is always formed on the lower side surface in the vertical direction of the V-shaped grooves 8, the observer H can feel the stereoscopic effect more clearly.

As shown in FIGS. 6(*a*) and (*b*), by performing fine adjustment of the cutting depth of the cutting blade 23 into the plate-like body 2, a line width W of the V-shaped groove 8 can be easily changed. That is, fine adjustment to change the line width W of the V-shaped groove 8 from a first V-shaped groove portion G1*a*(8) having the maximum width W1 to a second V-shaped groove portion G1*b*(8) having the minimum width W2, can be performed by a short movement distance 51 from the cutting blade 23 to a cutting blade 23'. Since fine adjustment of the line width W of the V-shaped groove 8 is allowed, the reproducibility of the image increases.

On the other hand, as shown in FIGS. 7(*a*) and (*b*), the example of cutting tools disclosed in Patent Document 1 uses a horizontal rotational blade 100. When the horizontal rotational blade is moved from the position indicated by a reference numeral 100 to the position indicated by a reference numeral 100', a movement distance S2 needs to be longer than the movement distance S1 of the present invention, in order to change the cutting depth. Therefore, the reproducibility of the image is lower than that of the present invention.

The carving work may be repeated a plurality of times. For example, in the case where the carving work is conducted two times, slight runout occurs between the plate-like body 2 and the cutting blade 23 owing to cutting resistance at the first carving work, whereby slight roughness occurs on the surface of the result image display panel 1. In such a case, if the second carving work is conducted with a depth slightly deeper than the depth of the first carving work, the roughness of the surface is polished and the surface state improves. For example, if the depth of the first carving work is 0.5 mm, the depth of the second carving work is adjusted to be deeper than the first depth by 0.01 to 0.03 mm. The way of fine adjustment of the second depth varies depending on the first working depth.

Since the surface state improves by the repeated carving work, it becomes possible to express an image that requires higher reflectance. In addition, by conducting the second carving work only for a part of the image display panel 1, it becomes possible to express an image using variation in reflectance based on the different numbers of times of the work.

Regarding the work direction of the second carving work, if the turn-back work as shown in FIG. 4(*a*) is conducted for the first time, the second carving work may turn back similarly to the first carving work, or may be conducted in the same direction as shown in FIG. 4(*b*). In this case, in the second V-shaped groove portion G2(8) and the fourth V-shaped groove portion G4(8), the up-cut slope surface is down-cut, thereby giving an impression that the image display panel 1 is rough as a whole. This is suitable for expressing an image that does not require clear stereoscopic effect, e.g., "snowy image".

On the other hand, if the first work is conducted in the same direction as shown in FIG. 4(*b*), also the second carving work needs to be conducted in the same direction in order to maintain the clear stereoscopic effect of the image display panel 1.

Thus, by selecting the way of carving work depending on an image to be displayed, it becomes possible to express various images.

[Observation Position and Angle of V-Shaped Groove]

As shown in FIG. 2, the image display panel 1 is lit from an obliquely upper position with respect to the vertical direction by the lighting apparatus L. In this case, the mirror surface reflective light Lm is emitted downward. However, on the contrary, the lighting apparatus L may be provided at a lower position. In this case, the mirror surface reflective light Lm is emitted upward, thereby obtaining the same effect.

For the lighting apparatus L, an LED lamp or the like is used, for example. A horizontal distance LL1 between the lighting apparatus L and the image display panel 1 is, for example, 300 mm, and a vertical distance LL2 between the lighting apparatus L and the image display panel 1 is, for example, 500 mm or longer. In this case, a lighting angle La is, for example, about 25 degrees. Although not shown, a plurality of LED lamps are arranged at intervals of about 100 to 150 mm. By such arrangement, light from each LED lamp overlaps with each other on the panel, whereby reflective light that is not direct but soft is obtained.

The color of the lighting apparatus L to be used is changed as appropriate in accordance with the design of an image to be displayed. Normally, a white lighting apparatus of 4,000 Kelvin is used, but a lamp-color or green lighting apparatus may be used. Besides, indirect lighting may be used.

As shown in FIG. 1, in order for the observer H to catch reflective light of light emitted by the lighting apparatus L and have an image focused, the observer H needs to be positioned at a reference observation position HP that allows the observer H to catch the reflective light. The reference observation position HP is determined relative to the image display panel 1. The reference observation position HP is not a point but an area having a certain range.

When the light from the lighting apparatus L reaches the V-shaped groove 8 and is reflected, reflective light such as the mirror surface reflective light Lm or the scattered reflective light Ld occurs. In order to cause more reflective light, it is preferable that a groove angle 8*a* of the V-shaped groove 8 is from 50 to 145 degrees, for example. As shown in FIG. 8(*b*), if the groove angle 8*a* is larger than 145 degrees, the mirror surface reflective light Lm occurs but becomes more likely to diffuse, and as a result, sufficient reflective light for causing the effect of the present invention cannot reach the observer H. In addition, the width of the inter-groove portion 9 becomes rather small, thereby causing a risk of losing the inter-groove portion 9 depending on fine adjustment of the cutting direction. Therefore, it becomes difficult to perform fine adjustment of the depth, so that the work accuracy can deteriorate. On the other hand, as shown in FIG. 8(*c*), if the groove angle 8*a* is smaller than 50 degrees, most of light is absorbed by the surface layer portion 5, and slight amount of light that has come into the V-shaped groove is reflected toward a groove bottom 8*c*, so that the light does not reach the observer H. Therefore, sufficient reflective light for causing the effect of the present invention cannot be obtained.

More preferably, it is desired that the groove angle 8*a* of the V-shaped groove 8 is 90 degrees as shown in FIG. 8(*a*). Since the blade tip angles of generally available cutting tools are usually 90 degrees, the production cost can be suppressed. In addition, fine adjustment of the cutting depth can be performed.

[Overall Manufacturing Method]

The manufacturing method will be described step by step.

1) As shown in FIG. 9, color pictures are synthesized to obtain the entire image 10 of an elaborate picture. Thereafter, adjustment of brightness and conversion to monochrome are performed.

2) As shown in FIG. 10, the entire image 10 is divided into the first image part 11 to the fourth image part 14, thereby obtaining a plurality of image display panels 1. Further, from the entire image 10, sample image parts are determined. As such sample image parts, a highlight part a) having the highest brightness, a brightness drastic change part b) where the brightness drastically changes, and a middle brightness part c) having a middle brightness, are determined, which are used for adjustment of brightness, i.e., cutting depth. Also, a cutting work starting part d) having a reference brightness for starting the work is determined for each image display panel.

3) Picture data is introduced into a 3DCAD, and NC data as work data is created by a 3DCAM. A 2-dimensional image is converted to be stereoscopic by the 3DCAD in accordance with the brightness of a monochrome image.

Figure 11:
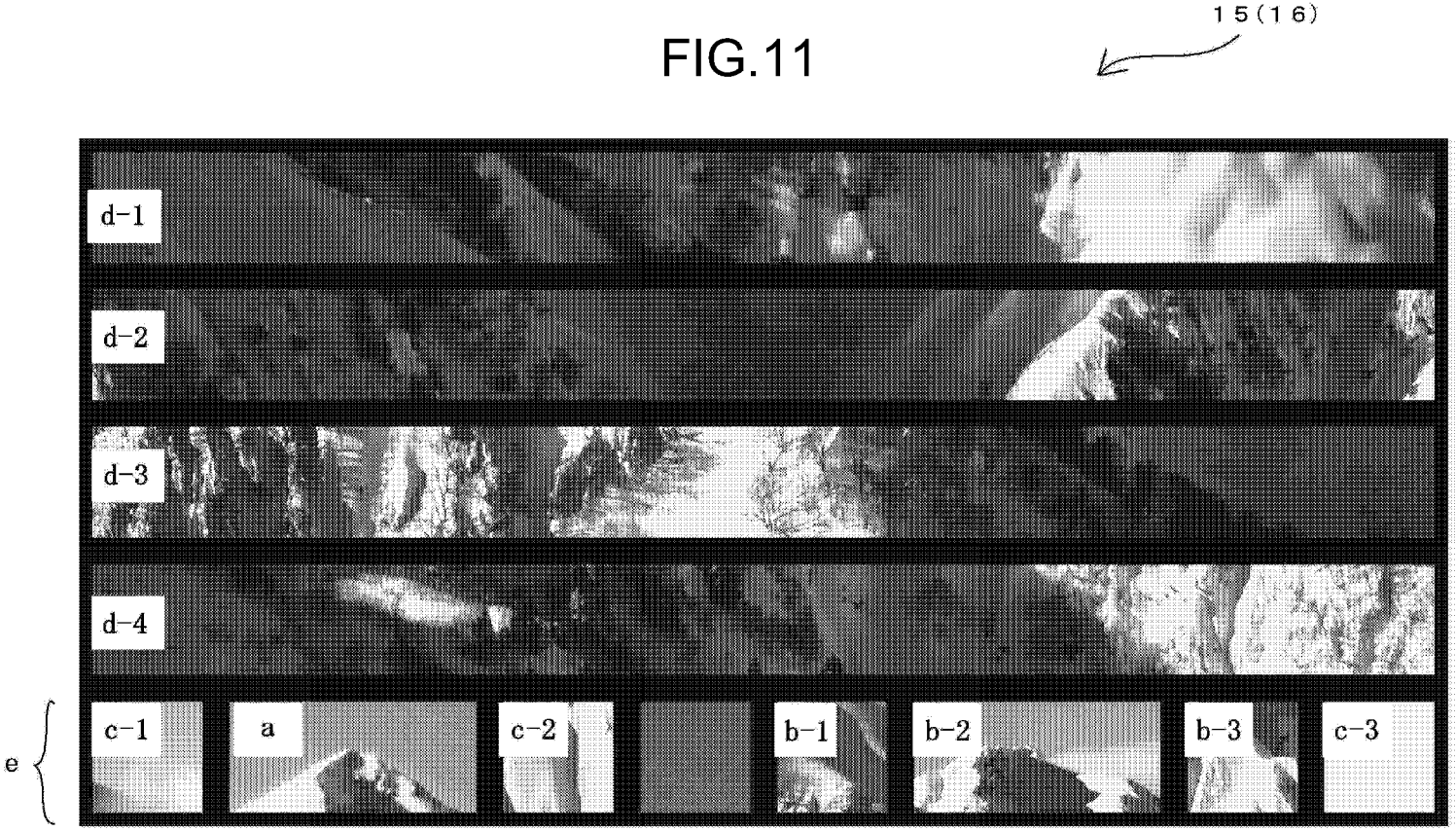
FIG. 11 is a diagram showing a sample image collection including sample image parts of the entire image, and a reference image display panel.

4) As shown in FIG. 11, the determined sample image parts a) to d) are collected to generate a sample image collection 15. The sample image collection 15 is used as reference image display panel data for adjusting the brightness, that is, the cutting depth, in order to obtain unity of brightness on each panel or among a plurality of panels.

5) As shown in FIG. 12, a cutter path is printed on a same-size paper by using the NC data, to perform simulation of voluminous sense.

6) A material subjected to black alumite treatment, as the surface layer portion 5, is closely adhered to a metal plate. If the material is too thick, the adhesiveness to the metal plate deteriorates. Therefore, the thickness of the material is 1 mm, for example.

7) In the carving work, first, a reference image display panel 16 is created based on the sample image collection 15 shown in FIG. 11. The cutting work starting parts d) of the reference image display panel 16 are cut off in advance for respective panels, to be compared side by side with initial portions of carving when the work for the plate-like body 2 is started. The highlight part a) to the middle brightness part c) which are used for confirming brightness expression, that is, brightness expression confirmation parts e) are collectively used.

8a) The carving work for the plate-like body 2 is started to create each image display panel 1. In order to adjust the depth of carving based on comparison with the reference image display panel 16, the work is once stopped after the plate-like body 2 is initially carved by about 100 mm. Then, the plate-like body 2 is compared with the cutting work starting part d) of the reference image display panel 16, and if the depth is insufficient, the cutting blade 23 is set to be deeper.

8b) When the entire image composed of a plurality of panels is created, the cutting work starting parts are used for adjusting brightness balance among all the panels. The reference image display panel 16 as a reference of the cutting depth for all the panels is created at an initial stage at which the cutting condition does not change significantly, whereby the brightness can be adjusted even when the cutting condition is changed with progress of the work.

8c) Then, after the depth of the cutting blade 23 is adjusted, the carving work is started again, and then the carving work is progressed to the final line.

9) After the carving work is finished, check is conducted again by comparing the image display panel 1 with the brightness expression confirmation parts e) of the reference image display panel 16. Whether or not the highlights are clearly expressed over the entire image is confirmed by the highlight part a), whether or not the minimum depth (no V-shaped groove) and the maximum depth (V-shaped groove depth of 0.5 mm) comply with the expression at the coordinate origin set by the working apparatus 20, is confirmed by the brightness drastic change part b), and whether or not middle brightness is expressed so as to occupy a sufficient area as a reference of brightness is confirmed by the middle brightness part c).

10) Finally, a cutting agent is washed away. A cutting agent corrodes a metal plate such as an aluminum plate and clouds the surface thereof, resulting in deterioration of reflectance. Therefore, the cutting agent is washed away immediately after the work is finished.

Before the cutting work for the image display panel 1, the cutting work starting parts d) of the image display panels 1 corresponding to the respective image parts 11 to 14 are all created at once, and depth adjustment for the entirety is performed in advance. Therefore, it becomes possible to absorb error due to the differences among the panels or the differences in the states of the tool and the blade.

As an additional step, coloring work may be further conducted for a part of the image display panel 1 after the above work is finished. Acrylic paint such as delta ceramcoat (commercial product) is diluted to color the panel by hand-painting. In this case, the expressiveness increases by multiple colors without influence on reflection.

[Other Embodiments]

Next, the second to fifth embodiments of the present invention will be described. It is noted that the same members as those of the above embodiment are denoted by the same reference numerals.

In the first embodiment, as shown in FIG. 13(*a*), center lines 8*b* of the V-shaped grooves Ga to Gc with respect to the line width direction are parallel. However, the V-shaped grooves 8 may be formed such that the center lines 8*b* are oriented in directions different from each other. In addition, as shown in the second embodiment in FIG. 13(*b*), the V-shaped grooves 8 may be formed such that the center lines 8*b* of the V-shaped grooves 8 are inclined toward the reference observation position HP of the observer H. Thus, by concentrating the reflective light on the observer H, the observer H can observe shading expression more clearly. This configuration is also suitable for such a case where the entire image 10 having an increased height HH is used or a case where the image display panel 1 is placed at a higher position than the observer H.

In the third embodiment of the present invention, as shown in FIG. 14, in the plate-like body 2, a synthetic resin thin plate 3*b* is closely adhered to a metal thin plate 3*a* to form the main portion 3 having multiple layers. As shown in FIG. 14(*a*), if the main portion 3 is composed of the metal thin plate 3*a* having a decreased thickness and the synthetic resin thin plate 3*b* added in place of the decreased portion, it becomes possible to reduce the weight of the entire image display panel 1. In this case, as shown in FIG. 14(*b*), the plate may be carved up to the synthetic resin thin plate 3*b* at the lowermost layer. In this case, if a different color from that of the surface layer portion 5 is used for the synthetic resin thin plate 3*b*, an image composed of two colors can be displayed. Besides, if the synthetic resin thin plate 3*b* that is transparent is used, a light source may be placed on a back surface 6 side, and an image may be displayed by light Lt transmitted from the back surface 6.

Figure 15:
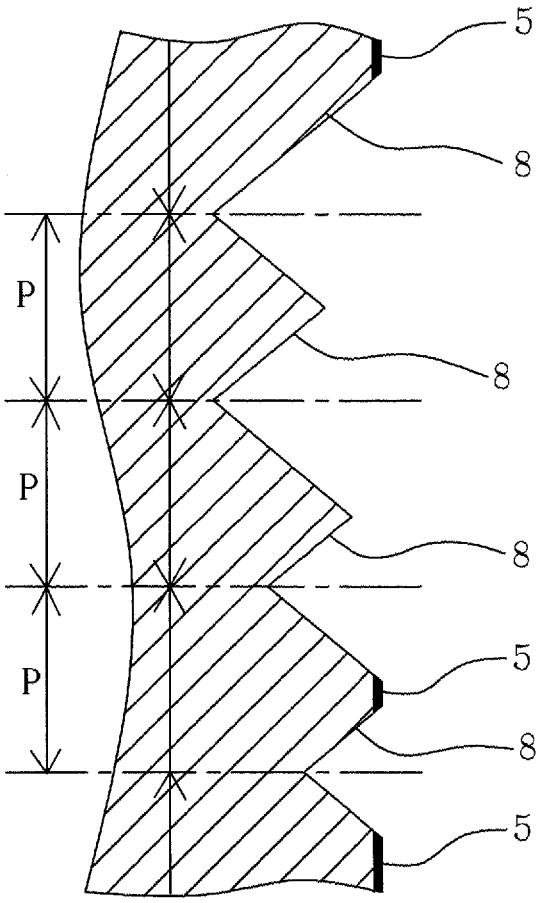
FIG. 15 shows the fourth embodiment and is a longitudinal sectional view showing the case where surface layer portions between the adjacent grooves are chipped off as a result of deep carving of the V-shaped groove.

In the fourth embodiment of the present invention, as shown in FIG. 15, the V-shaped grooves 8 are formed with the same groove pitch P so as to purposely chip off the surface layer portion 5 by deep carving. At a portion where the surface layer portion 5 is completely eliminated, subtle variation in contrast is expressed by only reflective light, thereby realizing expression with a sense of transparency. It is noted that, in this case, the light quantity of the lighting apparatus L needs to be equal to or larger than several times of that for the case of keeping the surface layer portion 5.

Further, the fifth embodiment of the present invention will be described. In the above embodiments, the image display panel 1 has the V-shaped grooves 8 corresponding to the shading of the entire image 10 to be displayed on the plate-like body 2. However, as shown in FIG. 16, concave grooves 80 may be formed instead of the V-shaped grooves 8.

Figure 17:
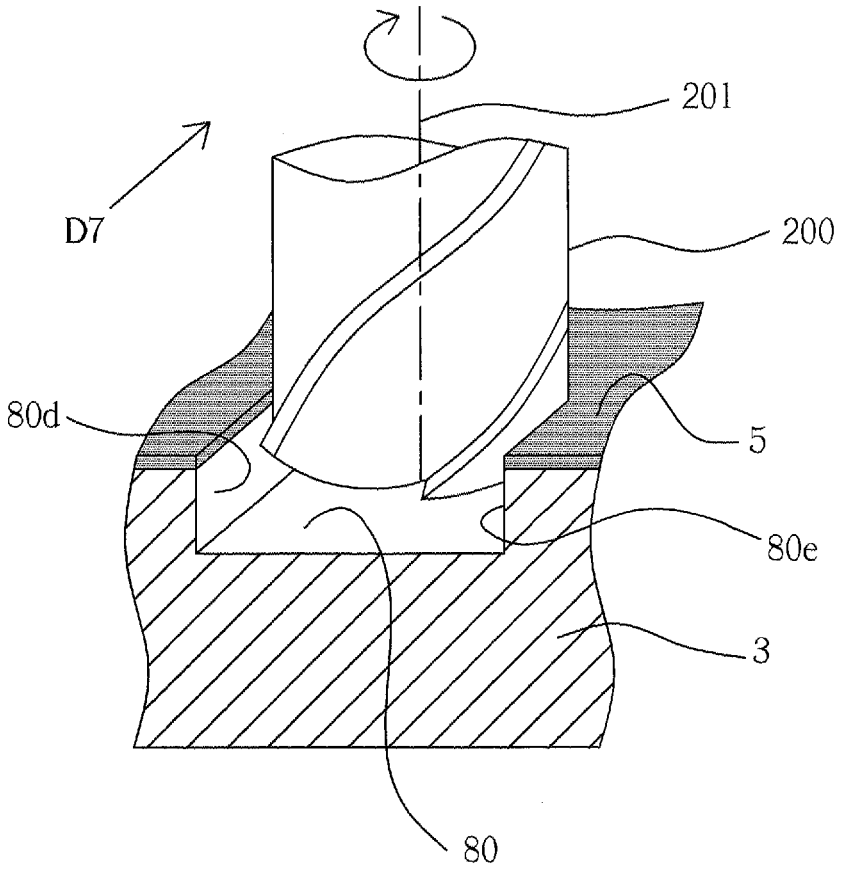
FIG. 17 shows the fifth embodiment and is a diagram showing the relationship between a cutting blade for cutting work and the concave groove.
Figure 18A:
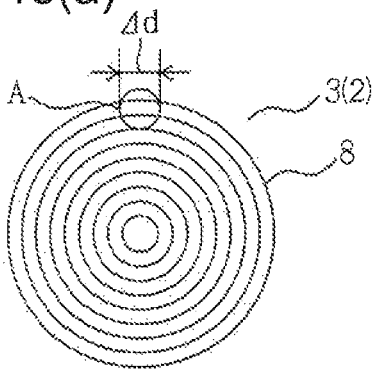
FIG. 18 shows examples of formation of the V-shaped grooves according to still other embodiments, in which diagrams (a) and (b) show the sixth embodiment, a diagram (c) shows the seventh embodiment, a diagram (d) shows the eighth embodiment, a diagram (e) shows the ninth embodiment, and the diagram (b) corresponds to FIG. 4.
Figure 18B:
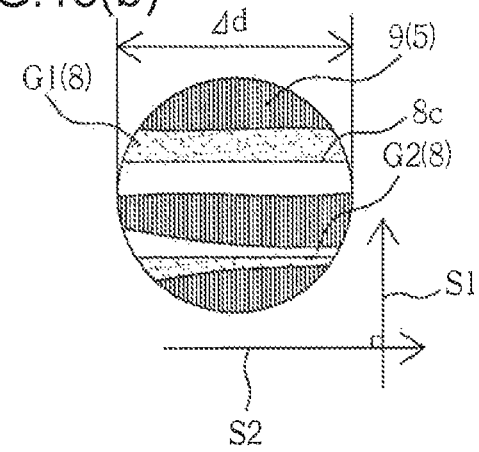
Figure 18C:
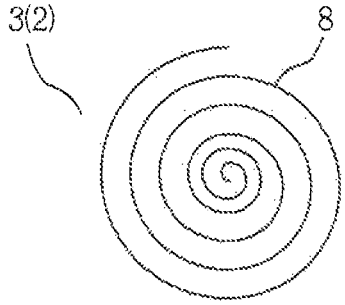
Figure 18D:
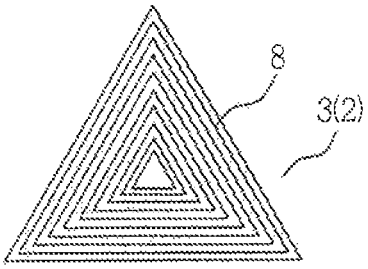
Figure 18E:
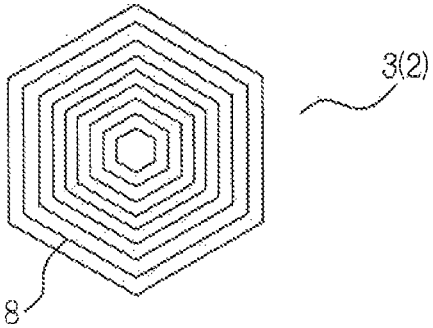

As shown in FIG. 17, the concave grooves 80 are formed through carving work by a cutting blade 200 for concave groove work. For example, an end mill or the like is used as the cutting blade 200. The cutting blade 200 moves in a direction D7 while rotating clockwise around a center axis 201, thereby forming the concave groove 80. As in the above embodiments, the depth of the concave grooves 80 is adjusted based on the output result of work simulation of image data. On the other hand, owing to the characteristic of the cutting blade 200, the width of the concave groove 80 is constant and both side surfaces 80*d* and 80*e* of the concave groove 80 are formed in parallel. It is noted that, in the mechanical work, the same working apparatus 20 as that of the above embodiments is used, but only for its blade, the cutting blade 200 for concave groove work is used.

The carving work for all the concave grooves 80 may progress in the same direction as in the above embodiments, or may progress in different directions between the adjacent lines. In addition, the concave grooves 80 may be formed on the plate-like body 2 having the multilayered main portion 3 as in the third embodiment, or the concave grooves 80 may be formed so as to completely eliminate some portions of the surface layer portion 5 as in the fourth embodiment.

Except for using the cutting blade 200 for groove work, the image display panel 1 of the present embodiment is manufactured by the same manufacturing method as that of the above embodiments.

In this case, as shown in FIG. 16(*a*), if light from the lighting apparatus L placed at, for example, an obliquely upper position relative to the image display panel 1 passes through a light path LP, the light is reflected as mirror surface reflective light Lm or scattered reflective light Ld, at the side surface 80*e* of the concave groove 80. In addition, as shown in FIG. 16(*b*), since the depth of the concave groove 80 varies based on the output result of work simulation, a width T of the side surface 80*e* also varies. Therefore, the quantities of the mirror surface reflective light Lm and the scattered reflective light Ld vary depending on the angle at which the observer H views, thereby allowing the observer H to feel stereoscopic effect. At this time, in order for the observer H to catch the reflective light, the reference observation position HP needs to be present in an oblique direction relative to the side surface 80*e* of the concave groove 80, for example, at an angle of 45 degrees upward from the side surface 80*e*. That is, the height HH of the image display panel 1 needs to be lower than the observer H.

On the other hand, if the lighting apparatus L is placed at an obliquely lower position, contrary to the above case, the reference observation position HP needs to be present in an oblique direction relative to the side surface 80*d* of the concave groove 80, for example, at an angle of 45 degrees downward from the side surface 80*d*. In this case, the image display panel 1 needs to be placed at a higher position than the observer H.

In the above embodiment, the V-shaped grooves 8 and other grooves are formed so as to cross the entire image, but formation of the grooves is not limited thereto. As shown in FIGS. 4 and 18(*b*), a plurality of grooves such as the V-shaped grooves 8 that are linear only have to be arranged in each minute section Δd of an image or the plate-like body that is minutely divided. Therefore, the grooves may be formed concentrically in a circular fashion or in an elliptic fashion as shown in FIG. 18(*a*), in a spiral fashion as shown in FIG. 18(*c*), in a triangular fashion as shown in FIG. 18(*d*), or in a polygonal fashion with four or more sides as shown in FIG. 18(*e*). In the polygonal fashion, the direction of the V-shaped grooves changes at each corner, but the V-shaped grooves do not cross and divide each other.

In these embodiments shown in FIG. 18, as shown in FIG. 18(*b*), a direction 51 in which the V-shaped grooves 8 are arranged corresponds to a "line width direction of the grooves", and a direction S2 perpendicular to the direction 51 in which the V-shaped grooves are arranged corresponds to the aforementioned "lateral direction". These directions are defined in each minute section, and can each differ as macroscopically viewed. In addition, an obliquely upward or downward direction relative to the lateral direction can be rephrased as a direction inclined in the line width direction from the center lines in the cross section with respect to the line width direction of the V-shaped grooves.

FIGS. 19 and 20 are pictures respectively showing the cases where the V-shaped grooves are formed in a spiral fashion and in a quadrangular fashion as macroscopically viewed. From each of FIGS. 19 and 20, it is found that the original graphic shown in a diagram (a) is displayed on an image display panel shown in diagrams (b) and (c).

Figure 21:
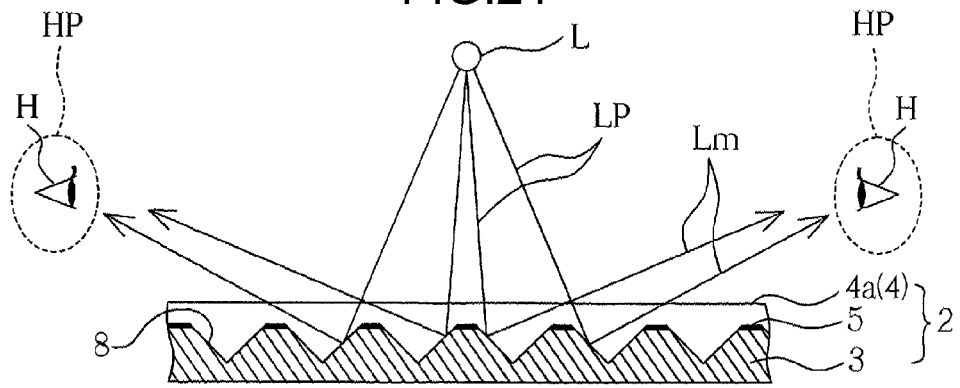
FIG. 21 is a longitudinal sectional view showing a used state of the sixth embodiment.
Figure 23:
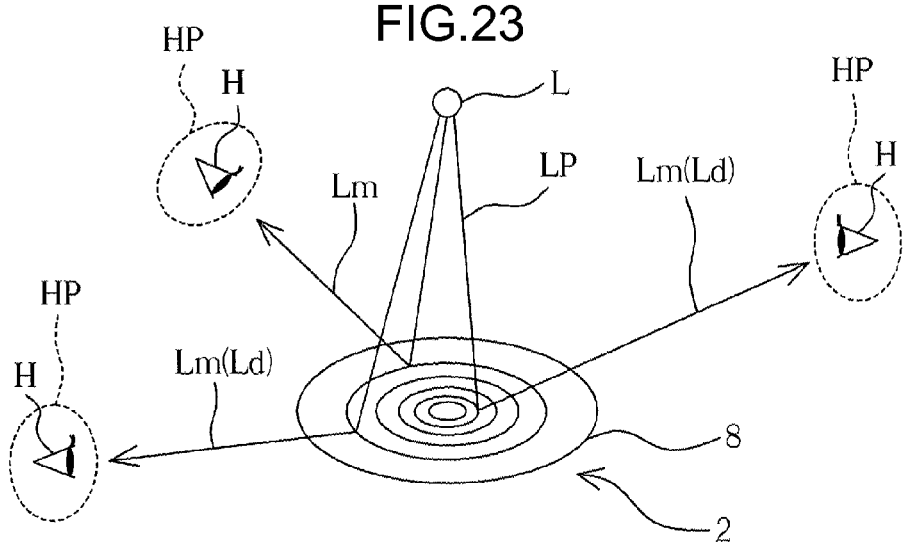
FIG. 23 is a perspective view of the embodiment shown in FIG. 21.

FIGS. 21 and 23 show the case where the lighting apparatus L as a light source is placed above the center of concentric circles in the embodiment shown in FIG. 18(*a*). It is understood that the reflective light (mirror surface reflection Lm and scattered reflection) caused by the V-shaped grooves 8 reaches the surrounding area, thereby obtaining the above-described effect.

Figure 22:
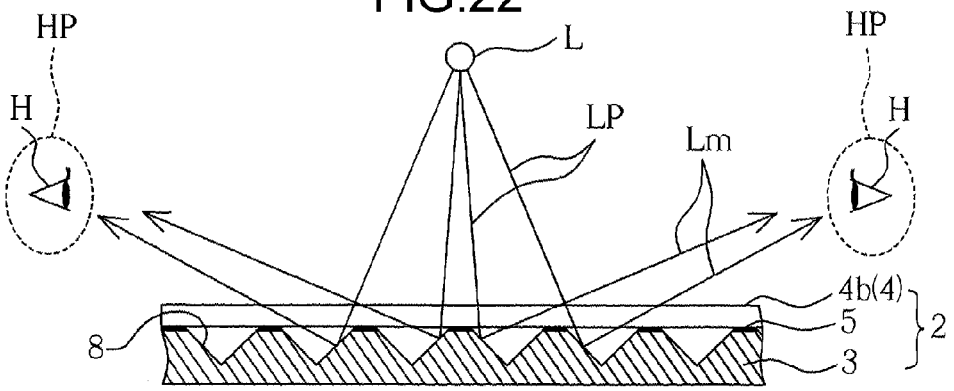
FIG. 22 is a diagram showing a modification of the embodiment shown in FIG. 21.

In the above embodiments, as shown in FIG. 21, a transparent protection layer 4 may be provided on the front surface side of the plate-like body 2. Such a protection layer 4 can prevent the plate-like body 2 from being tainted, and particularly, is effective for the case of using the plate-like body 2 as a table or an expensive floor material. In the example of FIG. 21, as the protection layer 4, a transparent fluid material, e.g., a synthetic resin such as acrylic resin may be injected to cure, thereby forming a resin protection layer 4*a*. In addition, as shown in FIG. 22, a plate-like protection layer 4*b* made of a similar synthetic resin may be provided. Instead of such a synthetic resin, a glass material may be used.

Figure 24:
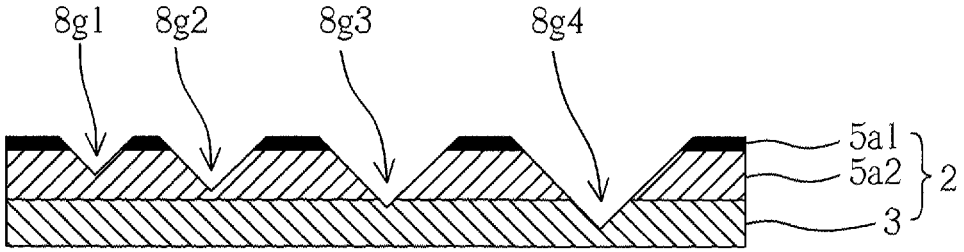
FIG. 24 is an enlarged sectional view of an image display panel showing the seventh embodiment.
Figure 25:
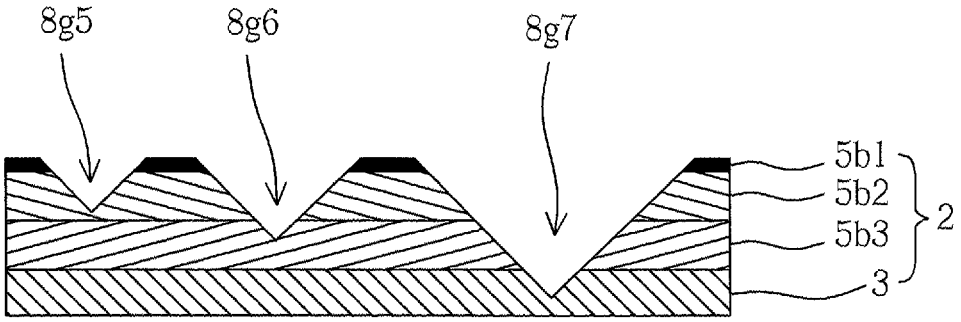
FIG. 25 is an enlarged sectional view of an image display panel showing the eighth embodiment.
Figure 26:
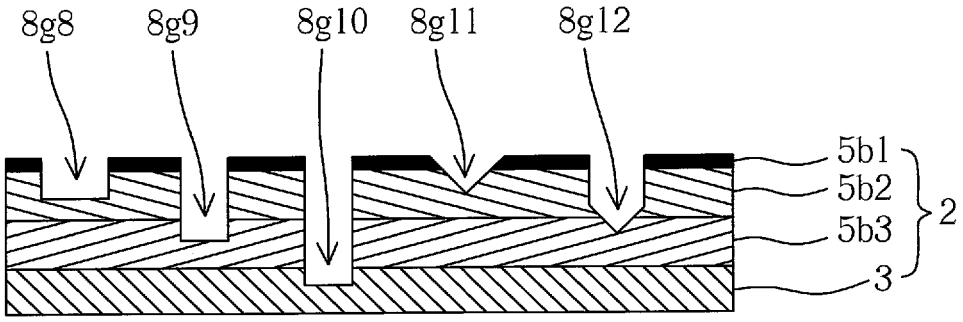
FIG. 26 is an enlarged sectional view of an image display panel showing the ninth embodiment.

Next, modifications of the surface layer portion 5 of the above embodiments are shown in FIGS. 24 to 26, in which the grooves 8 having different depths and forms are denoted by reference characters 8*g*1 to 8*g*12. In the embodiment shown in FIG. 24, two surface layer portions 5*a*1 and 5*a*2 having respective colors different from the main portion 3 are formed on the main portion 3. The second surface layer portion 5*a*2 is thicker than the first surface layer portion 5*a*1. Therefore, as shown by the reference characters 8*g*1 and 8*g*2, by changing the depth, the exposed area of the second surface layer portion 5*a*2 can be changed, whereby the displayed color can be adjusted. Similarly, also in the case where the grooves 8*g*3 and 8*g*4 reach the main portion 3, the exposed area of the main portion 3 relative to the second surface layer portion 5*a*2 can be changed depending on the depth of the grooves, whereby the displayed color can be adjusted.

In the embodiments shown in FIGS. 26 and 27, three surface layer portions 5*b*1, 5*b*2, and 5*b*3 having respective colors different from the main portion 3 are formed on the main portion 3. The second and third surface layer portions 5*b*2 and 5*b*3 are thicker than the first surface layer portion 5*b*1, so that the grooves 8*g*5 to 8*g*7 provide the same effect as the grooves 8*g*1 and 8*g*2. In the case of using the cutting blade for concave groove work shown in FIG. 17, as shown by the grooves 8*g*8 to 8*g*10, the displayed color can be selected by only the depth. In the case of forming the grooves 8*g*11 and 8*g*12 using the same cutting blade as in the first embodiment, if the surface layer portions 5*b*2 and 5*b*3 are thicker than the depth of the V-shaped portion of the tip of the cutting blade, the displayed color can be selected by only the depth, or the displayed color can be adjusted by adjustment of the width of the V-shaped groove at the boundary portion of the layers.

Finally, still other possible embodiments of the present invention will be recited. In the above embodiments, the entire image 10 is divided into four image parts 11 to 14, but the present invention is not limited thereto. For example, the entire image 10 may be directly used as one image display panel 1 without being divided, or may be divided into a plurality of image parts other than four image parts.

In addition, the main portion 3 only has to be a metal plate, and various materials such as brass, copper, or iron may be used instead of aluminum. However, an aluminum plate is suitable in that the aluminum plate can be easily processed. It is noted that if, for example, a transparent resin such as acrylic resin or a transparent material such as glass is used for the main portion 3 of the above embodiments, such an effect that light is transmitted from the back surface can be given, which is different from the effect obtained when a metal is used for the main portion 3.

The surface layer portion 5 only has to be made of a material that absorbs more light than the main portion 3, and is not limited to a material subjected to black alumite treatment. The surface layer portion 5 only has to be discriminated from the main portion 3, by, for example, having hue, brightness, and colorfulness different from those of the main portion 3. For example, in the case of using a material with a bronze color, an observer can feel a soft sense of air, unlike the case of using a black material. Besides, a color alumite such as a pink one or a green one may be used. A transparent resin layer such as acrylic resin or vinyl chloride resin, or a paint layer may be used for the surface layer portion 5, and a thick layer as shown in FIGS. 24 to 26 is easily formed by using such a material. As such a paint layer, besides an amino-alkyd resin paint baked coating, a resin paint layer which has high adhesiveness may be used, or a paint film such as an electrodeposition paint which deposits a main component of a paint on a metal surface, may be used.

Although the V-shaped grooves 8 are formed by the cutting blade 23 of the cutting tool having a conical tip, the present invention is not limited thereto, and the V-shaped grooves 8 may be formed by a laser or the like. However, in this case, it is necessary to use a cutting tool that allows fine adjustment of the line width W.

The embodiments of the present invention are configured as described above, but more comprehensively, they may include the configurations recited below.

An image display panel according to the present invention is an image display panel which displays an image by a plate-like body being processed through carving work, wherein the plate-like body has a main portion that transmits light therethrough, and a surface layer portion made of a material that absorbs the light, the carving work forms grooves that are linear, on the front surface side of the plate-like body, such that a plurality of the grooves are arranged in each of minute sections on the front surface, shading of the image is expressed by the depths of the grooves, and the image is displayed by absorption of light on the surface layer portion and reflection of light on the grooves.

A manufacturing method for an image display panel according to the present invention is a manufacturing method for an image display panel which displays an image by a plate-like body being processed through carving work, wherein the plate-like body has a main portion that transmits light therethrough, and a surface layer portion made of a material that absorbs the light, the carving work forms grooves that are linear, on the front surface side of the plate-like body, such that a plurality of the grooves are arranged in each of minute sections on the front surface, shading of the image is expressed by the depths of the grooves, and the image is displayed by absorption of light on the surface layer portion and reflection of light on the grooves.

In addition, an image display panel according to the present invention is an image display panel which displays an image by a plate-like body being processed through carving work, wherein the plate-like body has a main portion, and a surface layer portion made of a material that absorbs light more than the main portion, all or at least some of layers in the main portion and the surface layer portion include transmissive layers that transmit the light, the carving work forms grooves that are linear, on the front surface side of the plate-like body, such that a plurality of the grooves are arranged in each of minute sections on the front surface, shading of the image is expressed by the depths of the grooves, and the image is displayed by absorption of light on the surface layer portion and reflection of light on the grooves.

A manufacturing method for an image display panel according to the present invention is a manufacturing method for an image display panel which displays an image by a plate-like body being processed through carving work, wherein the plate-like body has a main portion, and a surface layer portion made of a material that absorbs light more than the main portion, all or at least some of layers in the main portion and the surface layer portion are formed as transmissive layers that transmit the light, the carving work forms grooves that are linear, on the front surface side of the plate-like body, such that a plurality of the grooves are arranged in each of minute sections on the front surface, shading of the image is expressed by the depths of the grooves, and the image is displayed by absorption of light on the surface layer portion and reflection of light on the grooves.

Further, an image display panel according to the present invention is an image display panel which displays an image by a plate-like body being processed through carving work, wherein the plate-like body is made of a material that reflects the light, the carving work forms grooves that are linear, on the front surface side of the plate-like body, such that a plurality of the grooves are arranged in each of minute sections on the front surface, shading of the image is expressed by the depths of the grooves, and the image is displayed by reflection of light on the grooves.

A manufacturing method for an image display panel according to the present invention is a manufacturing method for an image display panel which displays an image by a plate-like body being processed through carving work, wherein the plate-like body is made of a material that reflects the light, the carving work forms grooves that are linear, on the front surface side of the plate-like body, such that a plurality of the grooves are arranged in each of minute sections on the front surface, shading of the image is expressed by the depths of the grooves, and the image is displayed by reflection of light on the grooves.

It is noted that the above embodiments can be combined to be implemented, as appropriate.

INDUSTRIAL APPLICABILITY

The present invention can be used as an image display panel, image display panel installation equipment, and a manufacturing method for an image display panel. In addition, the present invention can be used as a substitute for a wall surface, a display, or a fusuma painting of a gallery, a museum, a temple, a hotel, or a restaurant. Besides, the present invention can be used as a fireproof dressed lumber of a door, an inner wall, or the like of a rail vehicle or the like. In addition, the present invention can be used as a table or the like by being placed substantially in a horizontal state.

DESCRIPTION OF THE REFERENCE CHARACTERS

1 image display panel
2 plate-like body
3 main portion
3*a* metal thin plate
3*b* synthetic resin thin plate
4 protection layer
4*a* resin protection layer
4*b* plate-like protection layer
5 surface layer portion
5*a*1 first surface layer portion
5*a*2 second surface layer portion
5*b*1 first surface layer portion
5*b*2 second surface layer portion
5*b*3 third surface layer portion
6 back surface
7 front surface
8 V-shaped groove
8*a* groove angle
8*b* groove center line
8*c* groove bottom
8*d*, 8*e* slope surface
8*g*1 to 8*g*12 groove
9 inter-groove portion
10 entire image
11 first image part
12 second image part
13 third image part
14 fourth image part
15 sample image collection
16 reference image display panel
20 working apparatus
21 fixed base
22 work
23 cutting blade
23*a* blade tip angle
23*b* blade center axis
80 concave groove
80*d*, 80*e* side surface
100 horizontal rotational blade
101 horizontal rotation axis
200 cutting blade
201 center axis
D1 to D7 direction of cutting blade
P groove pitch
L lighting apparatus
La lighting angle
LP light path
Lm mirror surface reflective light
Ld scattered reflective light
Lt transmitted light
LL1 horizontal distance between lighting apparatus and panel
LL2 vertical distance between lighting apparatus and panel
HH height
H observer
HP observer reference observation position
T width of side surface
W line width
W1 maximum line width
W2 minimum line width
w, w1, w2 groove width
Δd minute section

The invention claimed is:

1. An image display panel comprising:

a plate-like body comprising a metal main portion and a surface layer portion provided on a front surface side of the plate-like body, the surface layer portion absorbs light more than the metal main portion; and V-shaped grooves that are formed on the front surface side of the plate-like body, extending through the surface layer portion into the metal main portion such that the metal main portion is exposed on the front surface side by the V-shaped grooves, wherein a depth and a width of at least one of the V-shaped grooves change along a line direction of the V-shaped groove.

2. The image display panel according to claim 1, wherein the V-shaped grooves are formed such that center lines of the V-shaped grooves in a cross section with respect to a line width direction of the V-shaped grooves in each minute section are oriented in directions different from each other.

3. The image display panel according to claim 2, wherein the V-shaped grooves are formed such that the center lines of the V-shaped grooves in each minute section are configured to be inclined toward a reference observation position of a panel observer who observes the image display panel.

4. The image display panel according to claim 1, wherein a carving work of the V-shaped grooves in each minute section are formed in a same direction.

5. The image display panel according to claim 1, wherein a carving work of the V-shaped grooves in each minute section is conducted so as to progress in different directions between adjacent lines of the V-shaped grooves.

6. The image display panel according to claim 1, wherein an angle of each V-shaped groove is 50 to 145 degrees.

7. The image display panel according to claim 6, wherein the angle is 90 degrees.

8. The image display panel according to claim 1, wherein some of portions, of the surface layer portion, between the V-shaped grooves are entirely removed.

9. The image display panel according to claim 1, wherein the metal main portion of the plate-like body is composed of a metal thin plate and a synthetic resin thin plate bonded together.

10. The image display panel according to claim 1, wherein the V-shaped grooves are formed so as to extend in a circular or spiral fashion, or in a linear fashion such that the V-shaped grooves cross an entire image.

11. The image display panel according to claim 1, wherein a transparent protection layer is further provided on the front surface side of the plate-like body.

12. The image display panel according to claim 1, wherein the V-shaped grooves are formed so as to extend in a circular or spiral fashion, and the image display panel is used substantially in a horizontal state.

13. The image display panel installation equipment comprising the image display panel according to claim 1, and a lighting apparatus, wherein the lighting apparatus is placed in an oblique direction inclined in the line width direction from a center line in the cross section with respect to the line width direction of the V-shaped grooves in each minute section.

14. The image display panel according to claim 1, wherein the surface layer portion is composed of two or more layers different from each other in hue, colorfulness, or brightness.

15. A manufacturing method for an image display panel which displays an image by a plate-like body comprising the steps of: preparing the plate-like body that comprises a metal main portion and a surface layer portion provided on a front surface side of the plate-like body, the surface layer portion is made of a material that absorbs the light more than the metal main portion;

carving V-shaped grooves on the front surface side of the plate-like body whereby the V-shaped grooves extend through the surface layer portion into the metal main portion such that the metal main portion is exposed on the front surface side, and adjusting a depth of at least one of the V-shaped grooves along a line direction of the at least one of the V-shaped grooves thereby changing a width of the at least one of the V-shaped grooves and the surface layer portion along the line direction.

16. The manufacturing method for the image display panel according to claim 15, wherein the image is one of a plurality of images obtained by dividing an entire image which is displayed by combination of a plurality of the image display panels, a sample image collection is generated by collecting sample image parts sampled from a plurality of portions of the entire image, the sample image parts include a carving work starting part having a reference brightness for starting a carving work, for each image display panel, a reference image display panel is created through the carving work using the sample image collection, and a brightness of the carving work starting part corresponding to the image, of the reference image display panel, is compared with a brightness of a portion of the plate-like body where the carving work is started, thereby performing depth adjustment of the carving work.

17. The manufacturing method for the image display panel according to claim 15, the method further comprising the step of:

carving the V-shaped grooves in a predetermined pitch, wherein work data for the carving is generated such that the pitch is constant and that the surface layer portion between the V-shaped grooves is left even at a portion with the highest brightness of an original image.

18. The manufacturing method for the image display panel according to claim 15, the method further comprising the step of:

carving the V-shaped grooves in a same direction.

19. The manufacturing method for the image display panel according to claim 15, the method further comprising the step of:

carving the V-shaped grooves in different directions.

20. The manufacturing method for the image display panel according to claim 15, wherein the surface layer portion is composed of two or more layers different from each other in hue, colorfulness, or brightness.

21. An image display panel comprising:

a plate-like body comprising a metal main portion and a surface layer portion provided on a front surface side of the plate-like body, the surface layer portion absorbs light more than the metal main portion, and concave grooves that are formed on the front surface side of the plate-like body, at a predetermined pitch and extending through the surface layer portion into the metal main portion, the metal main portion is exposed on the front surface side by the concave grooves, wherein the concave grooves are formed such that both side surfaces thereof are substantially parallel in each minute section, at least one of the concave grooves is formed while a depth of the at least one of the concave grooves is adjusted along a line direction of the at least one of the concave grooves to change a width of the side surfaces of the at least one of the concave grooves along the line direction.

22. Image display panel installation equipment comprising the image display panel according to claim 21, and a lighting apparatus, wherein the lighting apparatus is placed in an oblique direction inclined in a line width direction from center lines in a cross section with respect to the line width direction of the concave grooves in each minute section, and a reference observation position of a panel observer who observes the image display panel is positioned in a direction inclined by 45 degrees in the width direction of the concave grooves from both side surfaces thereof.

23. A manufacturing method for an image display panel which displays an image by a plate-like body comprising the steps of:

preparing a plate-like body that comprises a metal main portion and a surface layer portion provided on a front surface side of the plate-like body, the surface layer portion being made of a material that absorbs light more than the metal main portion;

carving concave grooves on the front surface side of the plate-like body whereby the concave grooves extend through the surface layer portion and into the metal main portion such that the metal main portion is exposed on the front surface side;

forming both side surfaces of the concave grooves that are substantially parallel in each minute section;

adjusting a depth of at least one of the concave grooves along a line direction of the at least one of the concave grooves thereby changing a width of the side surfaces of the at least one of the concave grooves along the line direction.

24. An image display panel comprising:

a plate-like body comprising a metal main portion and a surface layer portion provided on a front surface side of the plate-like body, the surface layer portion absorbs light more than the metal main portion, and V-shaped grooves that are formed on the front surface side of the plate-like body, at a predetermined pitch and extending through the surface layer portion into the metal main portion, such that the main portion is exposed on the front surface side by the V-shaped grooves, wherein at least one of the V-shaped grooves is formed while a depth of the at least one of the V-shaped grooves is adjusted along a line direction of the at least one of the V-shaped grooves to change a line width of the at least one of the V-shaped grooves along the line direction.

* * * * *